US008668537B2

(12) United States Patent
Daikoku et al.

(10) Patent No.: US 8,668,537 B2
(45) Date of Patent: Mar. 11, 2014

(54) ENGINE CASE OF OUTBOARD MOTOR

(75) Inventors: Keisuke Daikoku, Shizuoka (JP); Tetsushi Achiwa, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 120 days.

(21) Appl. No.: 13/291,332

(22) Filed: Nov. 8, 2011

(65) Prior Publication Data

US 2012/0115376 A1 May 10, 2012

(30) Foreign Application Priority Data

Nov. 9, 2010 (JP) ..... 2010-251122
Nov. 12, 2010 (JP) ..... 2010-253955

(51) Int. Cl.
*B63H 20/32* (2006.01)

(52) U.S. Cl.
USPC ..... 440/76

(58) Field of Classification Search
USPC ..... 440/75, 76, 78, 111, 89 J, 89 R
See application file for complete search history.

(56) References Cited

U.S. PATENT DOCUMENTS

| | | | | |
|---|---|---|---|---|
| 4,538,996 | A | 9/1985 | Inwood | |
| 4,927,390 | A | 5/1990 | Kudoh et al. | |
| 5,201,238 | A | 4/1993 | Hayasaka | |
| 5,212,949 | A | 5/1993 | Shiozawa | |
| 5,344,350 | A * | 9/1994 | Hatch | 440/78 |
| 5,421,756 | A | 6/1995 | Hayasaka | |
| 5,730,632 | A | 3/1998 | Murata et al. | |
| 5,938,490 | A | 8/1999 | Rodler | |
| 6,358,109 | B1 | 3/2002 | Neisen | |
| 7,185,599 | B1 * | 3/2007 | Griffiths et al. | 440/111 |
| 7,485,019 | B1 | 2/2009 | Macier et al. | |
| 2005/0079775 | A1 | 4/2005 | Katayama | |
| 2006/0046583 | A1 | 3/2006 | Lawson | |
| 2007/0135000 | A1 | 6/2007 | Lawson | |

FOREIGN PATENT DOCUMENTS

| | | | |
|---|---|---|---|
| CH | 299921 | A | 6/1954 |
| EP | 0743432 | A1 | 11/1996 |
| FR | 2914904 | A1 | 10/2008 |
| GB | 2032871 | A | 5/1980 |
| JP | 2652861 | B2 | 9/1997 |
| JP | 2984027 | B2 | 11/1999 |
| JP | 3038606 | B2 | 5/2000 |
| JP | 3054962 | B2 | 6/2000 |
| JP | 2001-173443 | A | 6/2001 |
| JP | 2003-120378 | A | 4/2003 |
| WO | 84/03077 | A1 | 8/1984 |
| WO | 2005/049419 | A2 | 6/2005 |

OTHER PUBLICATIONS

Extended European Search Report, dated Nov. 13, 2013, which issued during the prosecution of European Patent Application No. 11188012.6.

* cited by examiner

*Primary Examiner* — Lars A Olson
(74) *Attorney, Agent, or Firm* — Troutman Sanders LLP

(57) ABSTRACT

An engine case houses engines in the inside of the case and is provided with a propulsion unit outside the case. A case main body housing the engines and assemblies of peripheral parts of the engines, and a case cover covering an opening at an upper portion of the case main body are included. Mufflers are installed on an exterior of a lower surface of the case, and on the lower surface of the case, housing portions housing the mufflers and exhaust hoses are formed.

8 Claims, 23 Drawing Sheets

ENGINE CASE OF OUTBOARD MOTOR

CROSS-REFERENCE TO RELATED APPLICATIONS

This application is based upon and claims the benefit of priority of the prior Japanese Patent Application Nos. 2010-251122, filed on Nov. 9, 2010, and 2010-253955, filed on Nov. 12, 2010, the entire contents of which are incorporated herein by reference.

BACKGROUND OF THE INVENTION

1. Field of the Invention

The present invention relates to, in an outboard motor, an engine case that houses an engine and so on constituting a power unit.

2. Description of the Related Art

Major types of a propulsion unit or a propulsion system for a craft or boat include an outboard motor, an inboard-outdrive motor, an inboard motor, and the like. The outboard motor, also called an outboard drive or the like, is integrally made up of an engine, auxiliary machines, gears and shafts of a drive system, a screw, and so on, and is mounted onto a transom board of a stern of a hull in general. Typically mounted in a small boat or the like, the outboard motor has a steering function and a tilting function.

Further, the inboard-outdrive motor, also called an inboard engine-outboard drive or the like as an installation method for a propulsion unit of a small craft or the like, has an engine mounted at an inboard stern portion and a drive unit made up integrally of reduction gears, a forward and reverse clutch, a propeller, and so on disposed on an exterior of the transom board.

Furthermore, the inboard motor is one of installation methods typically for a propulsion unit of a small craft or the like. Also called an inboard drive, it is a method placing an engine, reduction gears, and a forward and reverse clutch at an inboard central portion or the like, extending a propeller shaft toward the stern, and placing the propeller under the water from a craft bottom portion. A rudder determining a traveling direction of the craft is often placed behind the propeller.

As above, the outboard motor, the inboard-outdrive motor, and the inboard motor differ in engine mounting structure in the boat, so that each has an advantage and a disadvantage. In terms of user-friendliness or the like, for example, as for the inboard motor or inboard-outdrive motor, its engine chamber occupies part of a hull, so that an accommodation space is reduced to make its user-friendliness deteriorate. On the other hand, the outboard motor is placed outside the accommodation space, so that its user-friendliness in the hull is good, but regarding boarding or getting off via a stern and carriage of a thing (a fish, a net, a fishing line, or the like) via a stern, the user-friendliness deteriorates.

Further, in terms of watertight sealing that is quite important in this type of boat, an engine of the inboard motor or inboard-outdrive motor is mounted by being hung from a hole of a ceiling of the engine chamber. A ceiling cover of the engine chamber is just put on the engine chamber, and does not include a sealing member or the like in particular, so that water easily enters the engine chamber from a ceiling surface. Further, in the inboard-outdrive motor, the engine is placed in the hull, and a propulsion unit is placed outside the boat, so that a part coupling the engine and the propulsion unit is required. Thus, a large hole is opened in a transom board, and the engine and the propulsion unit are coupled. Watertightness of the above part relates to rigidity or flatness of the transom board, which affects securement of watertightness remarkably. The above watertightness is quite important not only for the inboard motor and inboard-outdrive motor, but also for the outboard motor.

[Patent Document 1] Japanese Patent No. 3038606

[Patent Document 2] Japanese Patent No. 2652861

[Patent Document 3] Japanese Laid-open Patent Publication No. 2001-173443

[Patent Document 4] Japanese Patent No. 2984027

[Patent Document 5] Japanese Patent No. 3054962

[Patent Document 6] Japanese Laid-open Patent Publication No. 2003-120378

Particularly, with respect to the above watertightness, more concretely, in the structure in Patent Document 1, an engine (2) in a hull and a propulsion unit (8) outside a boat are coupled via a universal joint (7). A large gap or space is required around the universal joint (7), and corresponding to the gap or space, a large hole is opened in a transom board (5) at a stern of the hull, and it is not easy to secure watertightness of a portion of the above hole.

Further, in Patent Document 2, an engine (12) is rubber-mounted in a hull (11). Exhaust is required to be guided to the outside of a boat from the engine, and the engine fluctuates because of it being rubber-mounted, so that flexible parts (23, 24) made of rubber or the like are required in an exhaust system (19, 21, 22). Also in the exhaust system, there is required a hole (19) passing through to the outside of the boat from the inside of the boat, and the above hole is positioned lower than a drive shaft in the case of exhaust being discharged into the water, resulting in that it is not easy to secure watertightness.

Further, particularly, a muffler constituting an exhaust device affects exhaust performance, sound deadening performance, and further engine performance, and so on, and how the muffler is disposed and structured is quite important.

In Patent Document 3, for example, it is structured that exhaust of an engine of an inboard-outdrive motor is guided to the outside of a watercraft through a catalyst (64) and a muffler (66). Unlike a vehicle, exhaust of a marine engine stays in a hull, and thus is not directly exposed to traveling air or the like, so that the exhaust is not cooled down easily. In this example, by a pump (42), air is pressurized to be supplied between an exhaust conduit (26) and a protective conduit (32) positioned around the exhaust conduit, and thereby the exhaust is cooled down.

Further, in Patent Document 4, similarly to a conventional outboard motor or inboard-outdrive motor, exhaust is discharged into the water, or is directly discharged into the air. In both the cases, a wet method to inject seawater into the exhaust is employed. In the above wet method, a surrounding heat insulation pipe for reducing the temperature of an exhaust system is not required, so that the exhaust system itself is not increased in size, and further it is also possible to reduce sound speed or sound pressure.

However, in Patent Document 3, even though the exhaust is cooled down as described above, the exhaust conduit (26) is needed to be lengthened in order to sufficiently cool down the muffler (66), and the sufficient volume of an installation part is required. The protective conduit (32) has to be increased in diameter with respect to the exhaust conduit (26) in order to obtain an air heat insulation layer, so that the volume occupied by an exhaust system in the hull is increased and it is difficult to secure an effective space in the watercraft.

Further, in Patent Document 4, in a method of underwater exhaust discharging, an engine (12) is fixed to a hull (11), and a propulsion unit (13) is moved when tilting, steering, or the like, so that a flexible part (bellows) is needed for an intermediate portion of the exhaust system.

Further, in a bellows structure in Patent Document 5, a bellows part (46) deteriorates by an exhaust component and is bent by steering and tilting, so that it is difficult to maintain its watertightness for a long period of time and the bellows part (46) is required to be replaced regularly. Further, when the bellows part (46) being replaced, a propulsion unit portion (7) has to be removed, so that man-hour is increased. On the other hand, in a method of aerial exhaust discharging, sound speed and sound pressure are reduced, but it is not possible to obtain sufficient sound deadening performance because a muffler is not provided.

Further, in Patent Document 6, in a typical exhaust structure of an outboard motor, an engine (7) and an exhaust outlet port (80) are integrally moved when steering or tilting, so that exhaust can be discharged into the water without a bellows structure. However, an exhaust system (46, 80) is placed integrally with the engine (7), so that it is difficult to place a catalyst having a sufficient size. Further, a lower end of the engine (7) (a bottom portion cylinder) and the water surface position are close to each other when a ship stops, so that deterioration of a catalyst and an oxygen sensor caused when being covered with water is a problem.

SUMMARY OF THE INVENTION

In consideration of such a situation, the present invention has an object to provide an engine case, of an outboard motor, that is excellent in user-friendliness, usability, and so on and secures high watertightness.

Further, the present invention has an object to provide an engine case, of an outboard motor, that secures excellent exhaust performance and exhibits an excellent effect in relation to peripheral parts or the like.

An engine case of an outboard motor according to the present invention being an engine case of an outboard motor that houses an engine in the case and includes a propulsion unit outside the case, the engine case of the outboard motor includes: a case main body housing the engine and assemblies of peripheral parts of the engine; and a case cover covering an opening at an upper portion of the case main body.

Further, the engine case of the outboard motor according to the present invention, in which a muffler is installed on an exterior of a lower surface of the case, and a muffler chamber housing the muffler and an exhaust hose is formed on the lower surface of the case.

Further, the engine case of the outboard motor according to the present invention, in which the muffler chamber is provided to be recessed inwardly of said case main body from an exterior of a lower surface of said case main body.

Further, the engine case of the outboard motor according to the present invention, in which the muffler chamber is formed along shapes of the muffler and the exhaust hose connected to the muffler.

Further, the engine case of the outboard motor according to the present invention, in which a muffler cover coupled to a bottom portion of the case and covering the muffler housed in the muffler chamber is placed.

Further, the engine case of the outboard motor according to the present invention, in which the muffler cover is fastened to said case main body by a flat-head screw.

Further, the engine case of the outboard motor according to the present invention, in which a suction pump is installed at an appropriate position of a bottom surface of the case, and it is designed such that water is allowed to be sucked at a suction part of the suction pump disposed at a bottom portion of the bottom surface of the case.

Further, the engine case of the outboard motor according to the present invention, in which a partition wall is formed along a substantially upward and downward direction inside the case, and a sucked-water supply pipe is provided between an upper end portion of a drainage guide passage set inside the above partition wall and the suction pump.

Further, the engine case of the outboard motor according to the present invention, in which a part of an exhaust system connected between the engine and the muffler is disposed inside of the partition wall.

DETAILED DESCRIPTION OF THE PREFERRED EMBODIMENTS

Hereinafter, a preferred embodiment of an engine case of an outboard motor according to the present invention will be explained based on the drawings.

Figure 1:
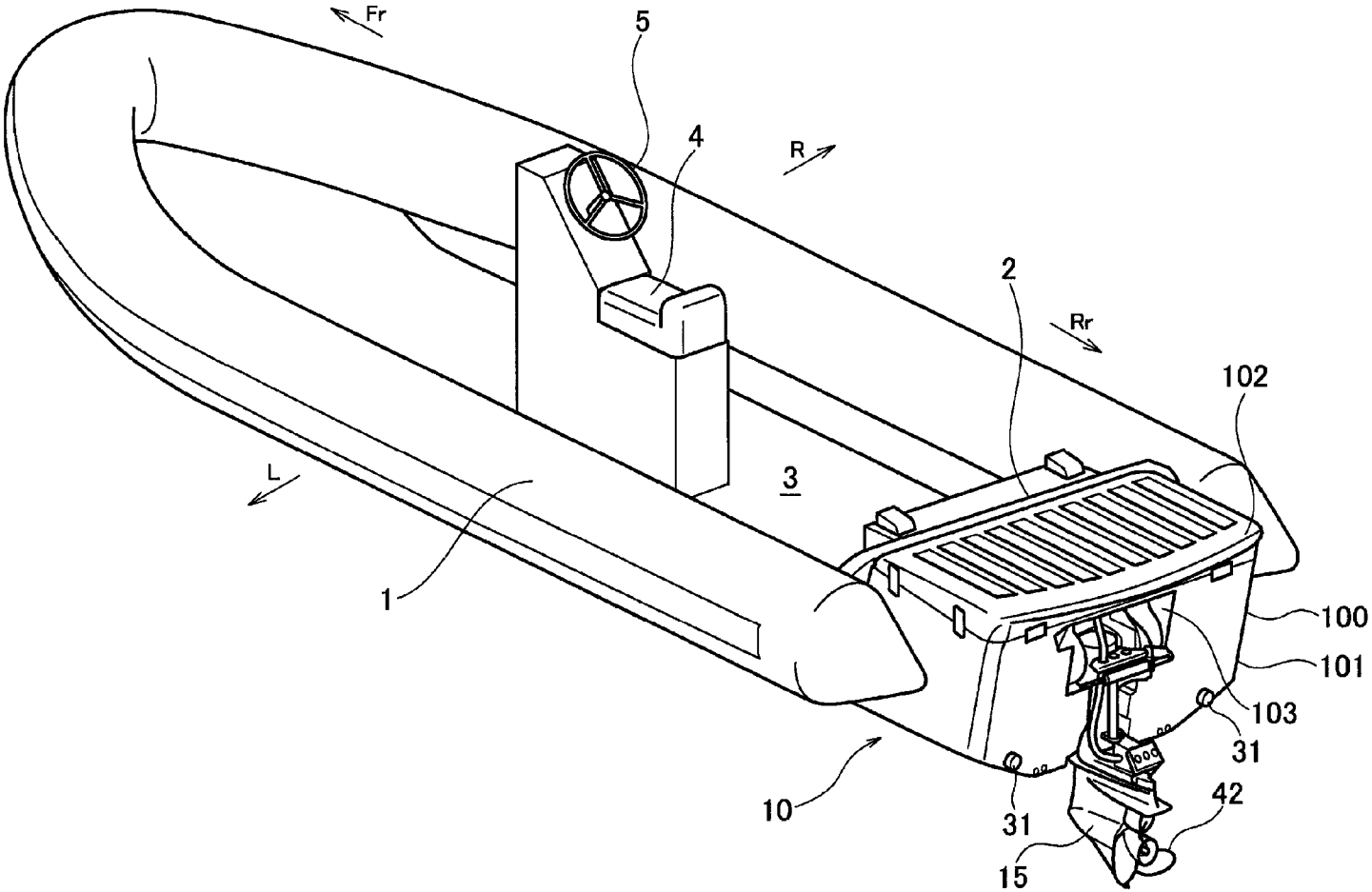
FIG. 1 is a perspective view illustrating an example of a craft or boat in which an outboard motor according to the present invention is mounted.

FIG. 1 illustrates an example of a craft or boat in which an outboard motor 10 according to the present invention is mounted. In this example, the craft is typically a middle or small sized one, and has a transom board 2 (stern board) at a rear portion of a hull 1. The outboard motor 10 is mounted using the transom board 2 as illustrated. Note that in substantial parts of the respective drawings to be referred to below, the front (bow side) is indicated by an arrow Fr, and the rear (stern side) is indicated by an arrow Rr. Further, right and left directions of the hull (hull width direction) are indicated by an arrow R and an arrow L, respectively as necessary.

Here, first, in the hull 1 according to this embodiment, as is in FIG. 1, a boat floor 3 is provided at a bottom portion of the hull 1, and at a rear end of the above boat floor 3, the transom board 2 is disposed. In the vicinity of a center portion of the boat floor 3, a cockpit 4 is provided, and at the cockpit 4, there are provided devices, instruments, measuring instruments, and so on necessary for steering such as a steering wheel 5. The outboard motor 10 is integrally equipped with motive power, a propulsion unit, a wheel turning device, a tilt device, and so on, and is constituted as what is called an all-in-one type. If ordinary fixtures such as a fuel tank and a battery are provided on a hull 1 side, the outboard motor 10 is operable.

Note that the craft is not limited to that of the illustrated example, and besides there are hulls having brackets or the like for mounting an outboard motor on a rear side of a transom board. That is, the outboard motor 10 of the present invention can be effectively applied also to a type having a stern board or an equivalent portion or member on a stern of a hull.

Figure 2:
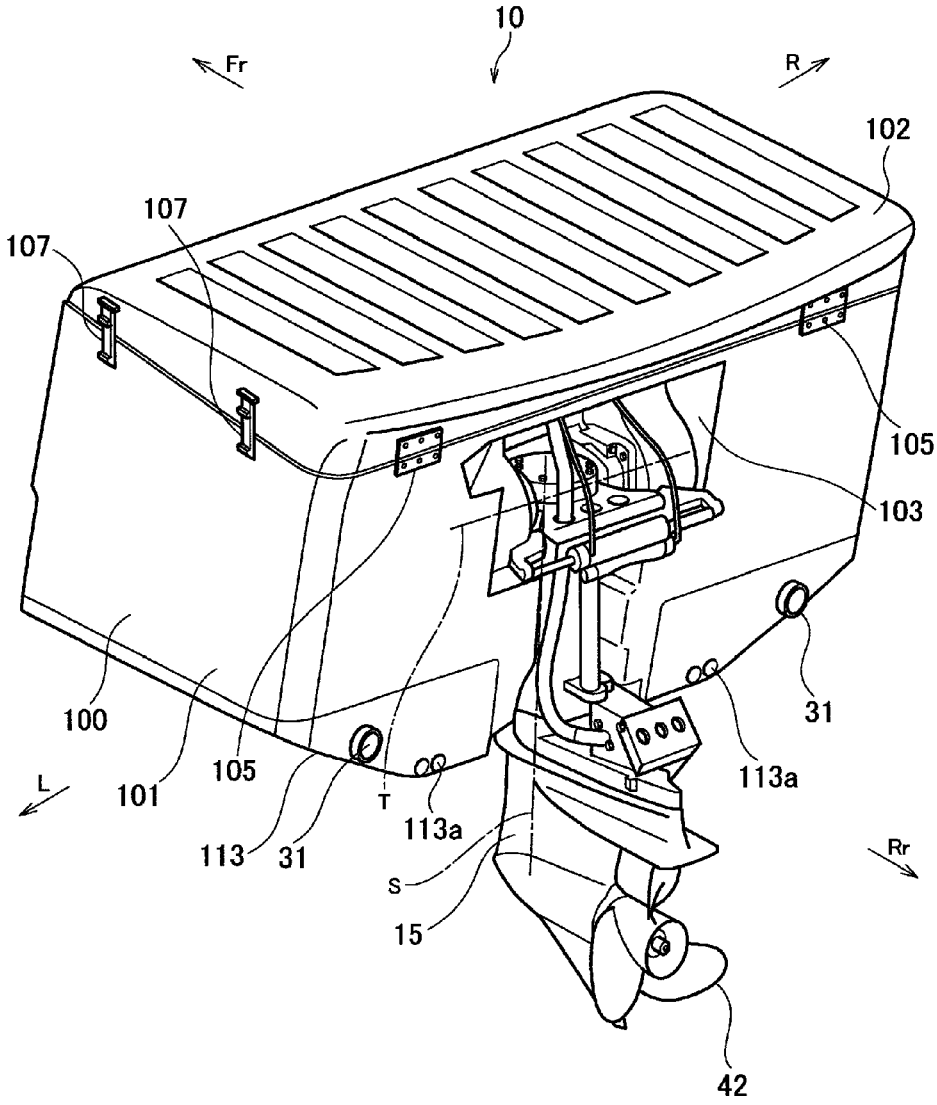
FIG. 2 is a perspective view illustrating an appearance of the outboard motor of the present invention.
Figure 3:
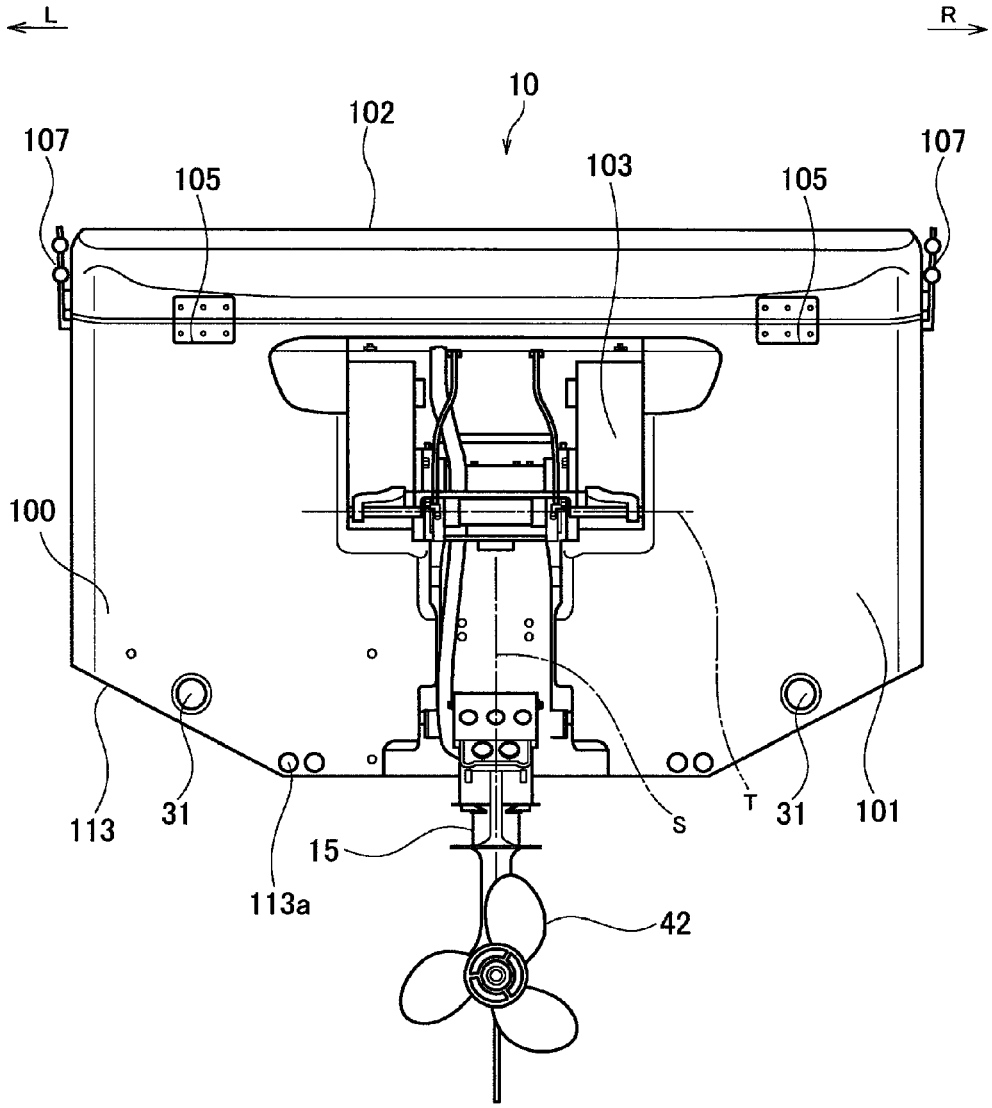
FIG. 3 is a rear view illustrating the appearance of the outboard motor of the present invention.
Figure 4:
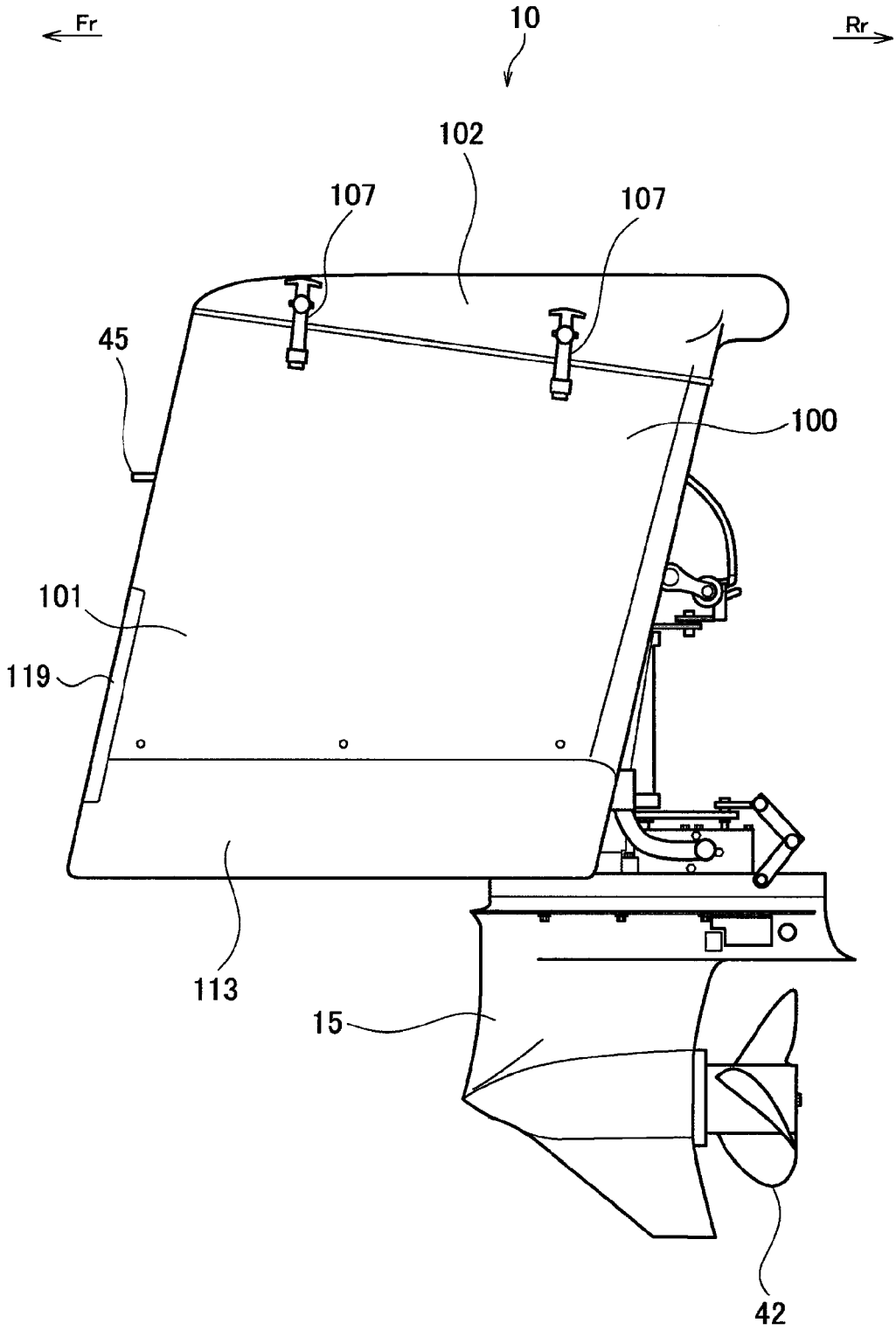
FIG. 4 is a side view illustrating the appearance of the outboard motor of the present invention.
Figure 5:
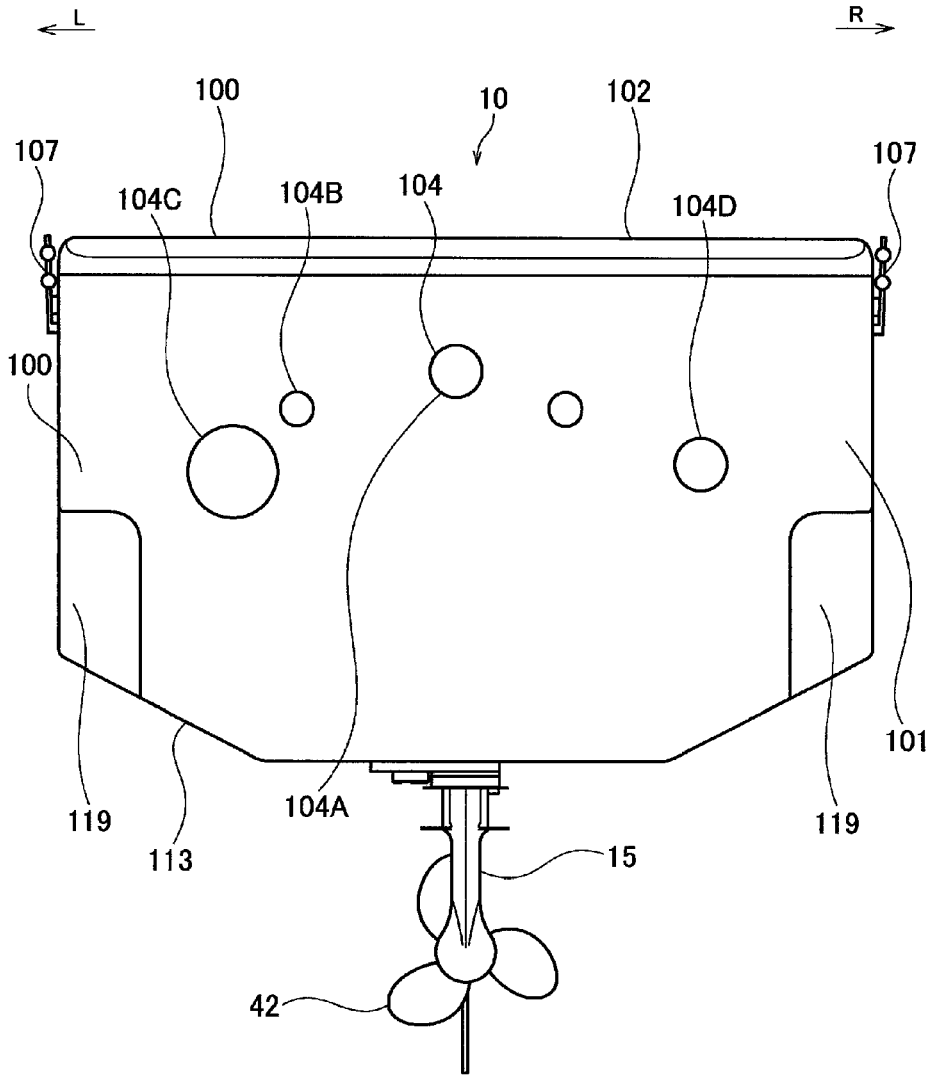
FIG. 5 is a front view illustrating the appearance of the outboard motor of the present invention.

FIG. 2 to FIG. 5 each illustrate an appearance of the outboard motor 10, FIG. 2 is a perspective view of the outboard motor 10, FIG. 3 is a rear view of the outboard motor 10, FIG. 4 is a side view of the outboard motor 10, and FIG. 5 is a front view of the outboard motor 10. The outboard motor 10 has an engine case 100, and in the above engine case 100, later-described engine units being a power source are housed, a screw (propeller) is disposed under a rear portion of the engine case 100, and by the engine units, the screw is rotary driven. The engine case 100 also functions as an exterior member constituting the appearance of the outboard motor 10, and exhibits a solid appearance as a whole.

With reference also to FIG. 1, the engine case 100 is formed as a case having substantially the same width as that of a stern part (typically the transom board 2) of the hull 1. The basic form of the engine case 100 in this example is set to be a substantially rectangular parallelepiped shape, and a longitudinal direction of the rectangular parallelepiped is set to be the hull width direction (hereinafter abbreviated as a beam direction). The engine case 100 has a case main body 101 that houses the engine units and peripheral parts or members of the engine units, and a case cover 102 that covers an opening 101*a* at an upper portion of the case main body 101 (see FIG. 12).

Figure 6:
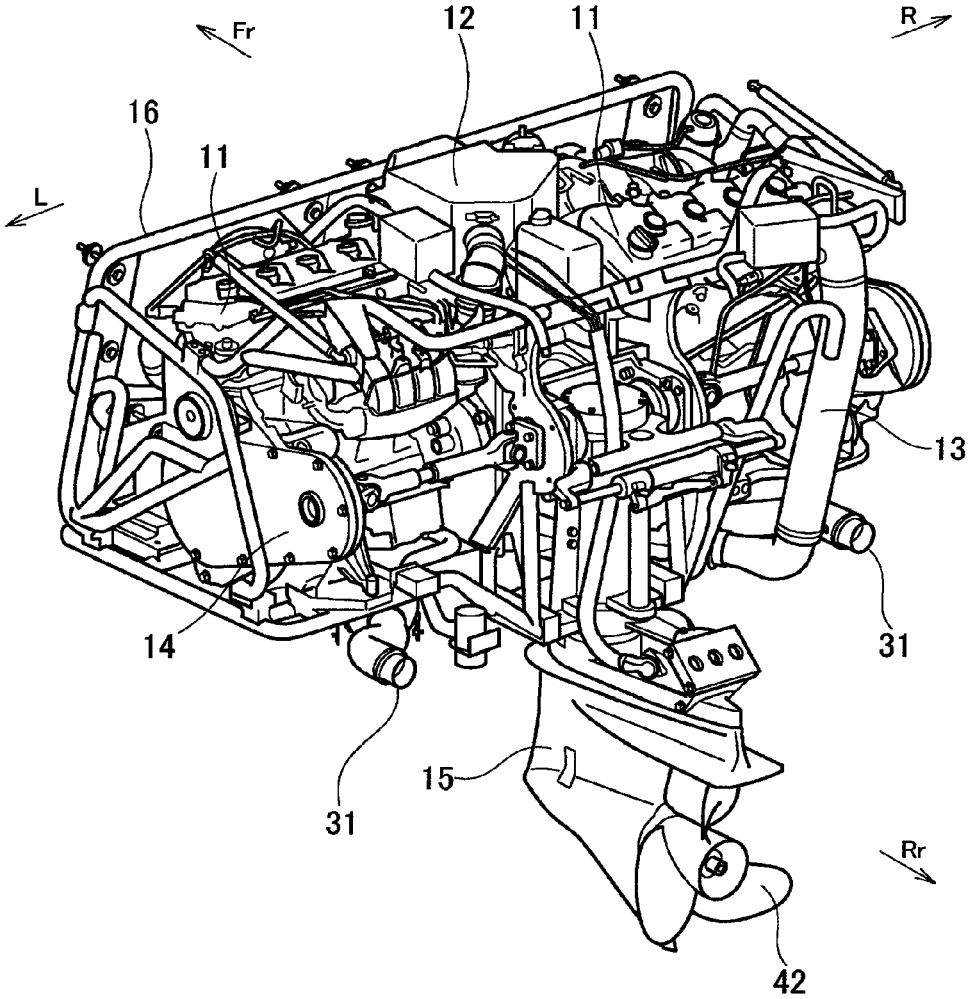
FIG. 6 is a perspective view illustrating a constitution example of the inside of an engine case in the outboard motor of the present invention.
Figure 7:
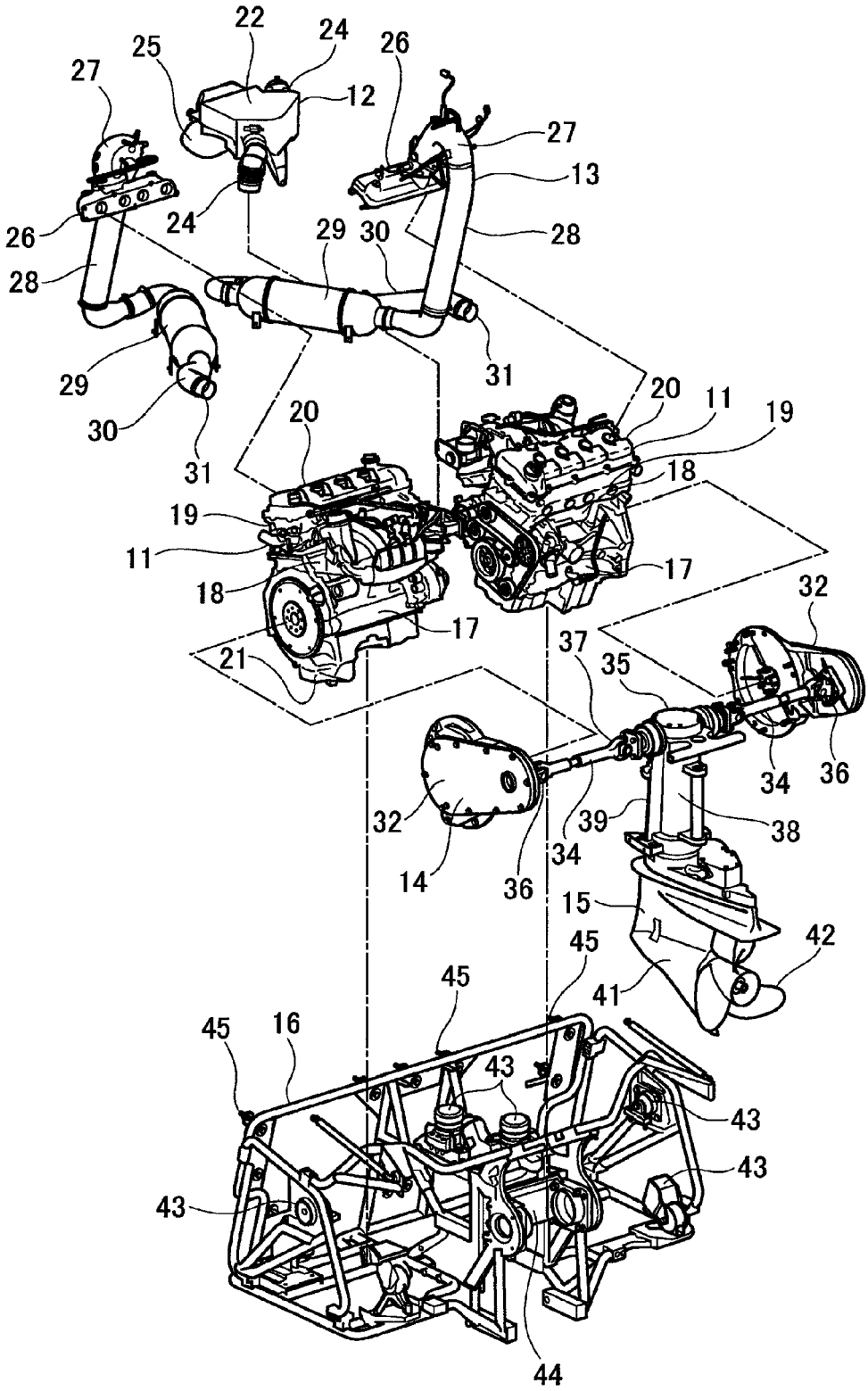
FIG. 7 is an exploded perspective view of a main constitution of the inside of the engine case in the outboard motor of the present invention.

Here, the engine units, the peripheral parts, and so on to be housed in the engine case 100 will be explained. The outboard motor 10 of the present invention has, as its power unit, an internal combustion engine as main motive power, which is operated to drive the propulsion unit. FIG. 6 illustrates a constitution example of the inside of the engine case 100 in the outboard motor 10, and FIG. 7 is an exploded perspective view of the main constitution in the engine case 100. In the engine case 100, engine units 11 constituting the power unit are compactly disposed and housed with a well-balanced weight distribution. In this embodiment, the two engine units 11 are provided, and the paired engine units 11 are disposed symmetrically about the center on the right and left of the engine case 100, with the longitudinal direction of its case being the beam direction. To each of the engine units 11, an intake system 12 and an exhaust system 13 are connected, and to an output end (a crankshaft) of each of the engine units 11, a motive power transmission mechanism 14 is coupled. The motive power transmission mechanisms 14 are coupled to a propulsion unit 15 at a middle portion in the right and left direction on a rear side of the engine units 11, and these components of the outboard motor are mounted and supported on a frame 16 as illustrated in FIG. 7.

Figure 8:
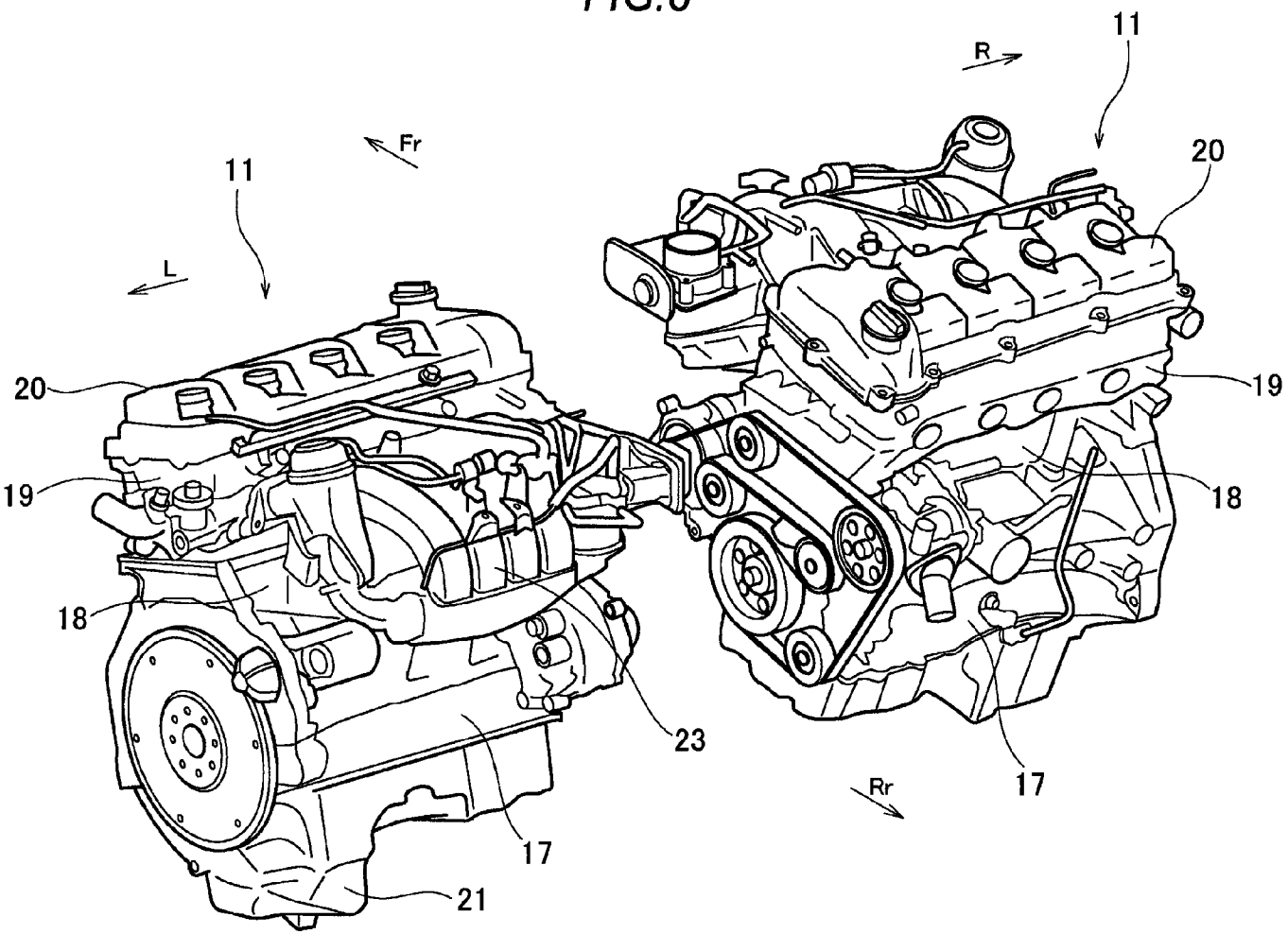
FIG. 8 is a perspective view illustrating a constitution and disposition example of engine units of the outboard motor of the present invention.

To explain more concretely, in the engine units 11, a water cooled, in-line, four-cylinder, four-stroke gasoline engine is used in this example. Note that the number of cylinders of the engine and the like can be changed appropriately as necessary, and are not limited to this example. With reference to FIG. 8, in each of the engine units 11, a crank case 17, a cylinder block 18, a cylinder head 19, and a cylinder head cover 20 are coupled integrally so as to be piled up sequentially, and an oil pan 21 is attached to a bottom portion. The crankshafts of the respective engine units 11 are disposed along the beam direction (right and left direction), and engine output shafts each to be coupled to an end of the crankshaft are disposed so as to be positioned on both right and left outer sides, namely the engine output shaft of the right engine unit 11 is disposed so as to be positioned on the right and the engine output shaft of the left engine unit 11 is disposed so as to be positioned on the left.

Figure 9:
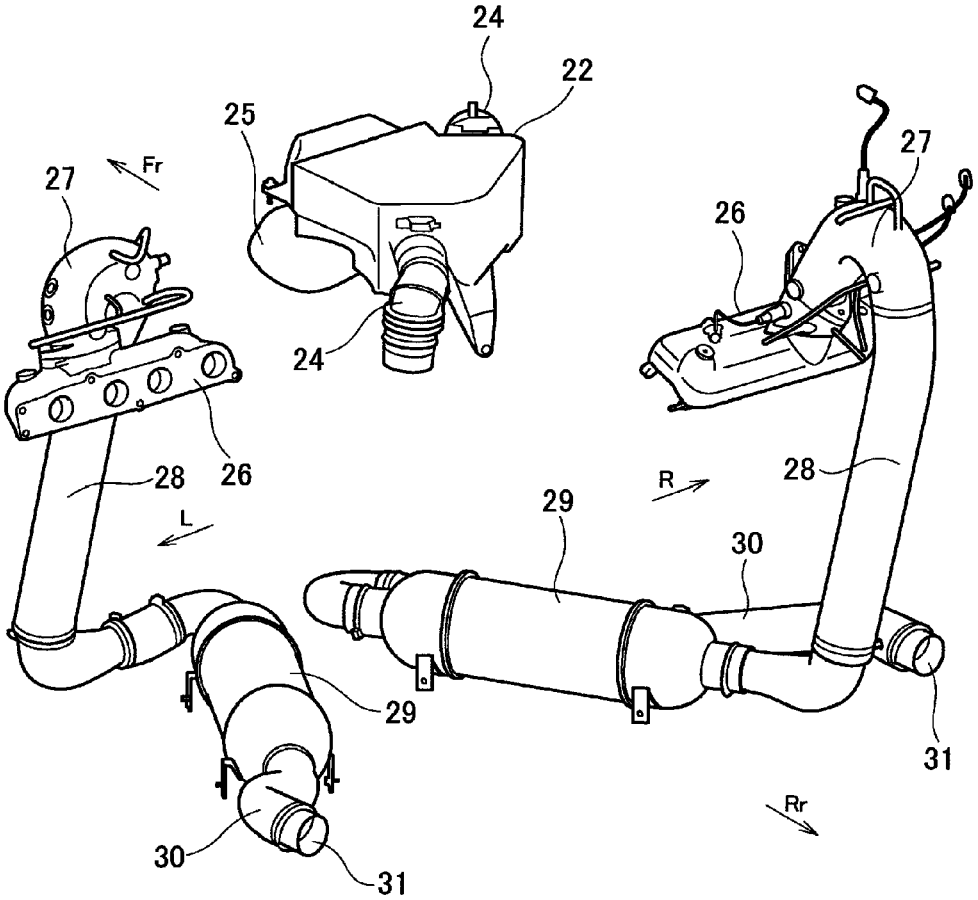
FIG. 9 is a perspective view illustrating a constitution and disposition example of intake and exhaust systems of the outboard motor of the present invention.

Next, in the intake system 12, as illustrated in FIG. 6, a single air cleaner 22 is disposed between the engine units 11. Then, as illustrated in FIG. 8, intake manifolds 23 are coupled to the front of the cylinder head 19 of the right engine unit 11 and to the rear of the cylinder head 19 of the left engine unit 11 respectively, and an intake pipe 24 connects the right intake manifolds 23 and the air cleaner 22, and connects the left intake manifolds 23 and the air cleaner 22. An intake pipe 25 extends to the hull 1 side of a front portion of the engine case 100 from a front portion of the air cleaner 22 (see FIG. 9), and is designed to take in air from an air intake port on a tip thereof. The air intake port is placed in a chamber or space in the hull 1, where it is not exposed to waves, splashes, rain, and the like. As illustrated in FIG. 8, in each of the engine units 11, the single intake pipe 25 branches into a plurality (four in this example) of the intake manifolds 23.

In the exhaust system 13, as illustrated in FIG. 7 and the like, exhaust manifolds 26 are coupled to the rear of the cylinder head 19 of the right engine unit 11 and to the front of the cylinder head 19 of the left engine unit 11 respectively, and the exhaust manifolds 26 are connected to a single exhaust pipe 27 in each of the engine units 11. Exhaust hoses 28 are connected to the exhaust pipes 27, and mufflers 29 are connected to the exhaust hoses 28 respectively. Exhaust hoses 30 are connected to the above mufflers 29, and exhaust gasses are designed to be discharged via exhaust outlet ports 31 attached to the exhaust hoses 30 respectively.

The mufflers 29, as will be described later, are installed on an exterior of a lower surface of the case main body 101 of the engine case 100. In the above case, the mufflers 29, the exhaust hoses 30, and so on are disposed so as not to project from the lower surface of the case main body 101 substantially, and exhausts are discharged into the water via the exhaust outlet ports 31 disposed in the vicinity of a lower portion on both right and left sides of a rear surface of the case main body 101 respectively, by well-balanced distribution on the left and right sides, which will be described later.

Figure 10:
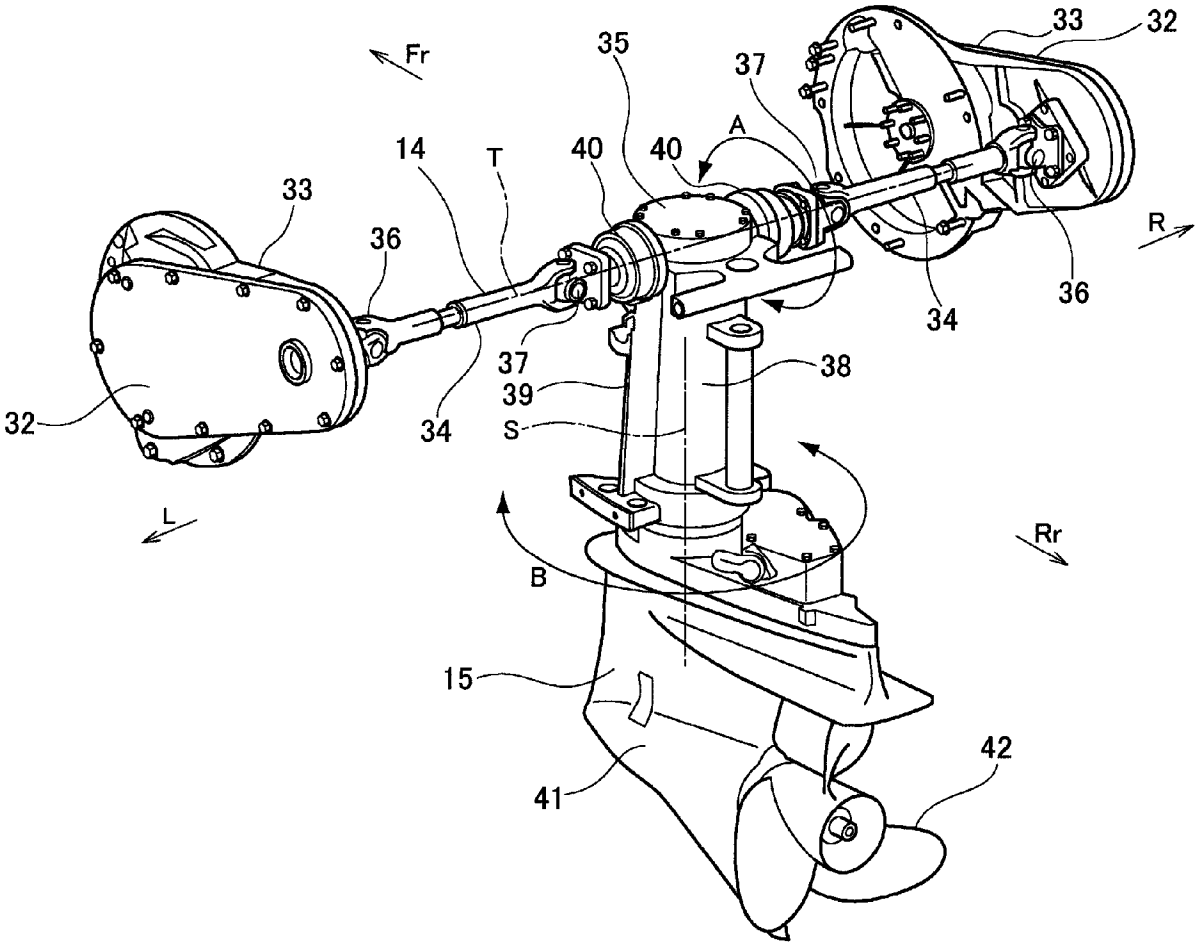
FIG. 10 is a perspective view illustrating a constitution and disposition example of motive power transmission mechanisms of the outboard motor of the present invention.

The motive power transmission mechanisms 14 transmit outputs of the engine units 11 to the propulsion unit 15. In the motive power transmission mechanisms 14, speed reducers 32, as illustrated in FIG. 10, are coupled to the engine output shafts of the right and left engine units 11 respectively. Each of the speed reducers 32 has gears axially supported in an easily rotatable manner in a casing 33, and has a drive shaft 34 coupled to an output shaft thereof. The right and left drive shafts 34 are disposed concentrically with each other and horizontally in the right and left direction, and are coupled to an intermediate speed reducer 35 at a middle portion therebetween. Each of the drive shafts 34 has both ends thereof coupled to the speed reducer 32 and the intermediate speed reducer 35 via universal joints 36 and 37 respectively.

In this embodiment, the intermediate speed reducer 35 includes a pair of input-side bevel gears coupled to the drive shafts 34 respectively and an output-side bevel gear engaging with the input-side bevel gears. The output-side bevel gear is coupled to a second drive shaft in a drive shaft case 38, and the intermediate speed reducer 35, the drive shaft case 38, and a swivel bracket 39 are coupled integrally to one another. The second drive shaft extends downward from the intermediate speed reducer 35. The swivel bracket 39, and so on are turnably supported on the case main body 101 via bearings 40, as will be described later.

As illustrated in FIG. 10 and the like, the propulsion unit 15 is disposed under the drive shaft case 38. The propulsion unit 15 includes a gear case 41 having gears for driving a propeller therein, and has a fin shape as a whole. A propeller 42 is attached to a rear end portion of the gear case 41. The second drive shaft passes through the drive shaft case 38 and further extends downward to reach the inside of the gear case 41. A final speed reducer is constituted in the gear case 41, and the propeller 42 can be rotary driven via the above final speed reducer.

Further, a tilt mechanism and a steering mechanism for the propulsion unit 15 are provided. Detailed explanations regarding the tilt mechanism and steering mechanism are omitted here, but first, the tilt mechanism allows the intermediate speed reducer 35, the drive shaft case 38, and the entire propulsion unit 15 to turn around a tilt shaft in an upward and downward direction. A tilt shaft T is set coaxially with the drive shafts 34, and as indicated by an arrow A in FIG. 10, tilting of the propulsion unit 15 can be performed around the tilt shaft T. Incidentally, it is also possible that the tilt mechanism includes a drive device such as what is called a power trim tilt (PTT) and an electro hydraulic type tilt mechanism is constituted.

Further, as indicated by an arrow B in FIG. 10, the steering mechanism allows the propulsion unit 15 to turn around a steering shaft S in a yaw direction (the right and left direction) (yawing). The above steering mechanism has, for example, an electrohydraulically driven steering cylinder to be reciprocated along a steering rod, with a hydraulic pump being a hydraulic source, and thereby the propulsion unit 15 is turned in the right and left direction, namely steeling of the propulsion unit 15 can be performed.

Figure 11:
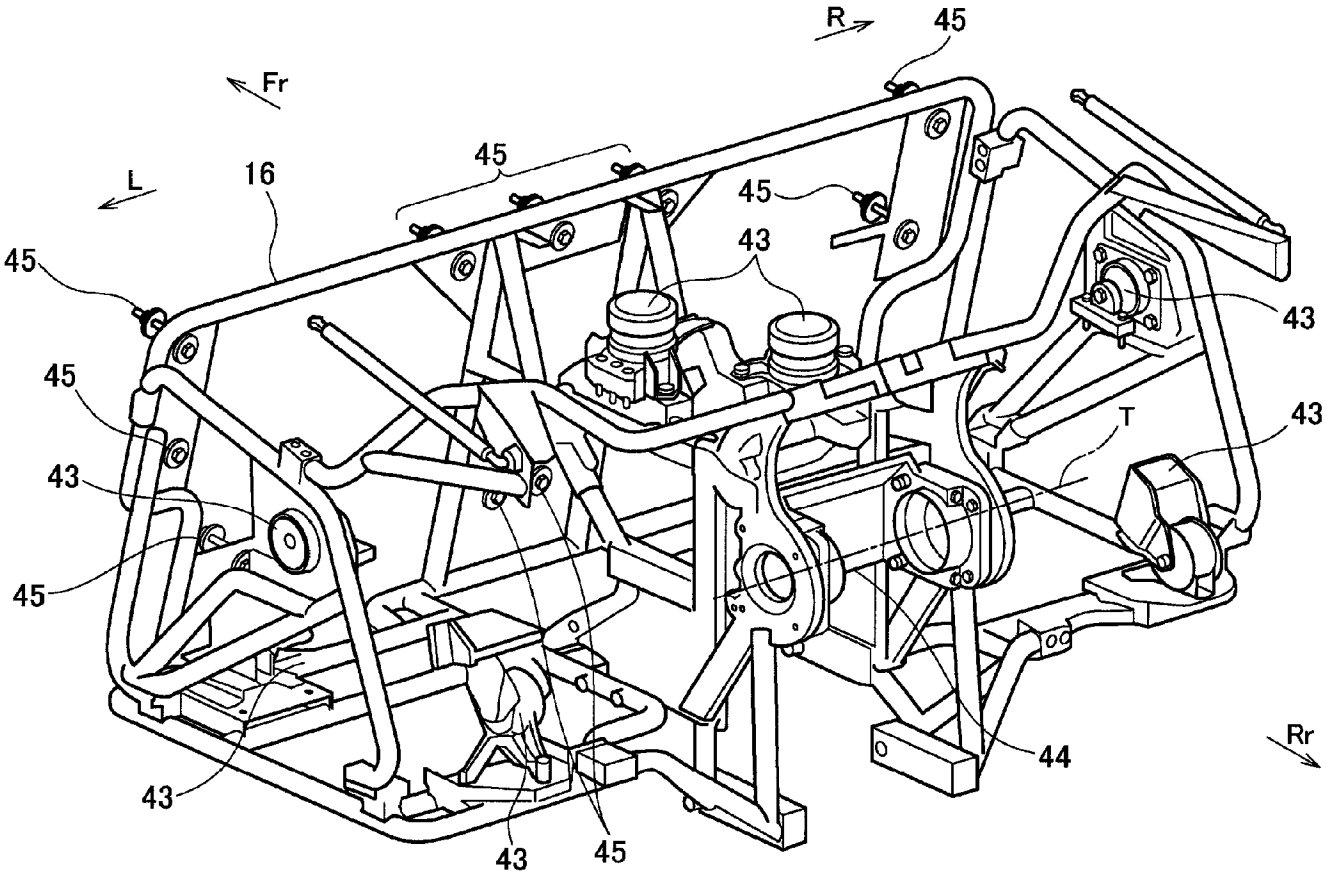
FIG. 11 is a perspective view illustrating a constitution and disposition example of a frame of the outboard motor of the present invention.

The above-described main components of the outboard motor 10 are mounted and supported on the frame 16 as illustrated in FIG. 6. As illustrated in FIG. 11, the frame 16 is formed to have an external shape substantially along the rectangular parallelepiped of the case forming the engine case 100, with the use of a material of a steel pipe or the like. On predetermined positions of the frame 16, a plurality of engine mounts 43 for mounting and supporting the engine units 11 are provided, and the engine units 11 are attached on the frame 16 via the engine mounts 43. Further, to a rear portion of the frame 16, there are attached main brackets 44 to which the bearings 40 for supporting the previously described swivel bracket 39 and so on are to be fitted.

Further, a plurality of transom bolts 45 are attached to a front surface portion of the frame 16 to face forward. The components of the outboard motor such as the engine units 11 are mounted on the frame 16, and the frame 16 on which the components are mounted is housed in the engine case 100. The transom bolts 45 are fastened to the transom board 2 through a front surface portion of the case main body 101 of the engine case 100, and thereby the entire engine case 100 can be fastened and fixed to the transom board 2. Incidentally, a seal, gasket, or the like is fitted to the transom bolts 45 projecting from the case main body 101 to thereby secure watertightness.

Then, the engine case 100 will be further explained in detail. As described previously, the engine case 100 has the case main body 101 housing the engine units 11 and the peripheral parts of the engine units 11, and the case cover 102 covering the opening 101*a* at the upper portion of the case main body 101. When the case cover 102 is closed to the case main body 101, the inside of the engine case 100 is turned into an enclosed space practically to thereby secure high watertightness. In the above case, the components of the outboard motor 10 are supported by the frame 16, and the frame 16 holds the engine units 11 and receives propelling force and steering force of the propulsion unit 15, namely loads of the components of the outboard motor 10 are not applied to the engine case 100 itself. Further, as illustrated in FIG. 1, the engine case 100 also functions as an exterior member of the outboard motor 10, and has the outboard motor 10 mounted therein to then exhibit a solid appearance as a whole.

As illustrated in FIG. 2 to FIG. 4, and the like, there is provided a recessed portion 103 formed so as to be recessed inwardly of the case main body 101, in a middle portion in the beam direction in a region from a rear surface portion to a bottom surface portion on a rear surface side of the case main body 101. In the vicinity of the above recessed portion 103, the propulsion unit 15 constituting a propulsion device, the tilt and steering mechanisms, and so on are provided. The recessed portion 103 is formed toward the front from the rear surface side of the case main body 101, and a necessary and sufficient gap is provided in the recessed portion 103 in order that the tilt mechanism and the steering mechanism, peripheral instruments or members of the tilt mechanism and steering mechanism, or the like do not interfere with the case main body 101 when tilting and steering.

As described previously, the fixtures such as a fuel tank and a battery are provided on the hull 1 side, and these fixtures and the outboard motor 10 are connected or coupled. In the above case, as illustrated in FIG. 5, a plurality of through holes 104 are formed through the front surface portion of the case main body 101 and the transom board 2 by boring them together. Specifically, there are formed a through hole 104A for inserting the intake pipe 25 for supplying combustion air to the engines, a through hole 104B for inserting a fuel pipe for supplying fuel to the engines from the fuel tank, a through hole 104C for passing a ventilation air pipe for venting the inside of the engine case 100, and so on. Furthermore, there is formed a through hole 104D for inserting cords or cables connecting devices or instruments or members in the engine case 100 and a steering device on the hull 1 side electrically (including a control signal and the like) or mechanically. Incidentally, a watertight retaining member (seal or the like) is provided on each of these through holes 104 when the intake pipe 25 and the like are installed.

Figure 12:
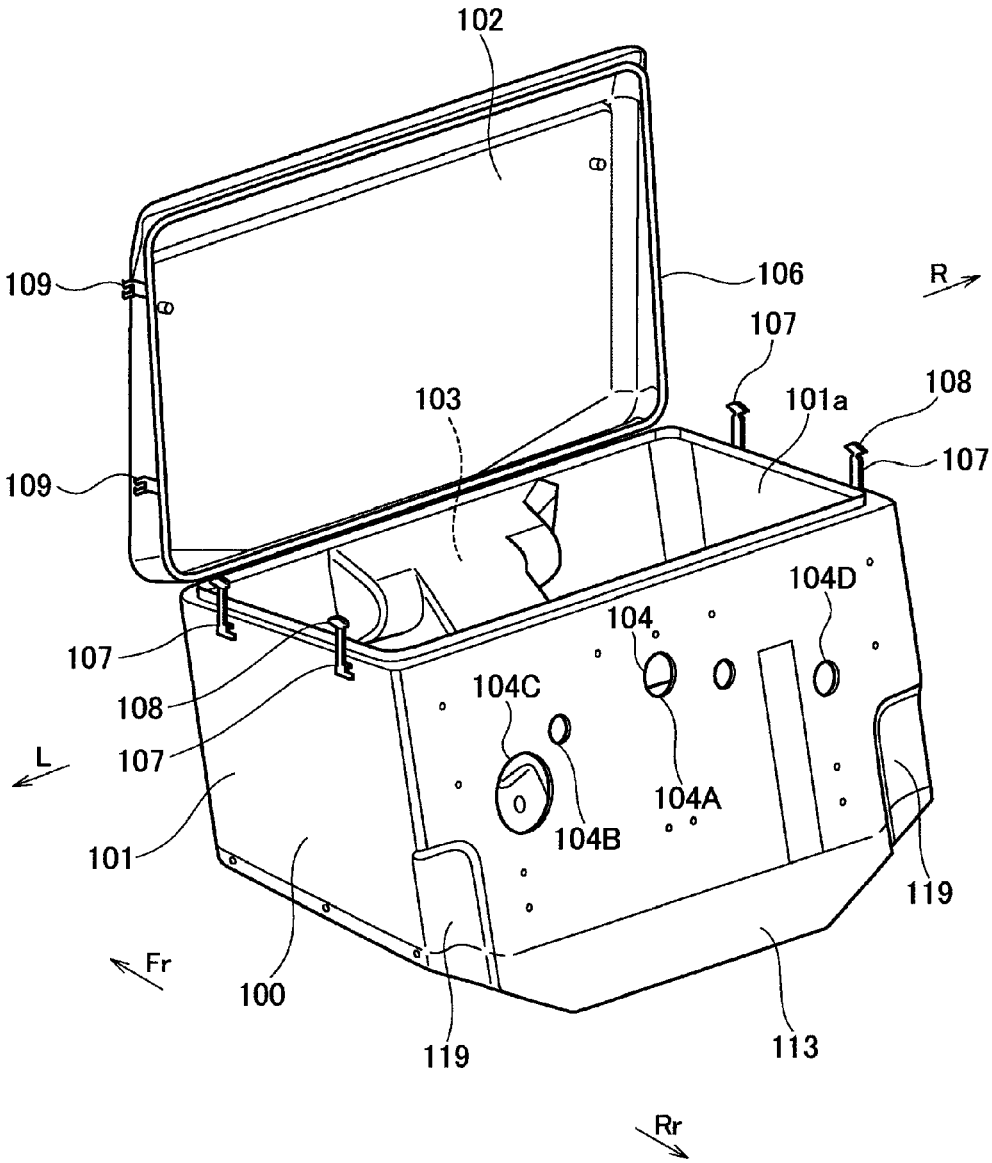
FIG. 12 is a perspective view illustrating a state where a case cover is opened in the engine case of the outboard motor of the present invention.

The case cover 102 constitutes an upper surface portion of the engine case 100 and is coupled turnably via hinges 105 in the vicinity of a rear portion upper end of the case main body 101, as illustrated in FIG. 2 or FIG. 3. By turning the case cover 102 based on the hinges 105 to open as illustrated in FIG. 12, the inside of the engine case 100 is released, and this allows freely accessing the engine units 11 and the like thus exposed in the engine case 100. The case cover 102 can be opened to perform an inspection or the like of the inside easily, and convenience for such kind of work can be improved.

A seal 106 is provided on closed portions or abutting surfaces of the case main body 101 and the case cover 12, as illustrated in FIG. 12, where high watertightness of the engine case 100 is secured and retained by closing the case cover 102 to the case main body 101. In the above case, the seal 106 is provided across the entire circumferences along the abutting surfaces of the case main body 101 and the case cover 102, as illustrated in FIG. 12. Then, when the case cover 102 is closed, the seals are tightly sandwiched between the closing portions of the case main body 101 and the case cover 102, and thus high watertightness against the engine case 100 can be obtained.

Further, there are provided lock mechanisms 107 fixing and holding the case cover 102 to its closed state when the case cover 102 is closed to the case main body 101. The above lock mechanisms 107 each include a handle 108 attached to the case main body 101 to be easily turnable and a handle receiver 109 provided on the case cover 102, for example. By turning the handle 108 toward the handle receiver 109, the handle 108 and the handle receiver 109 can be held in a locked state simply, and the lock state can be cancelled according to need.

In the above-described case, by the upper surface portion of the engine case 100, namely, an upper surface of the case cover 102 being made flat, the outboard motor 10 is integrated smoothly and continuously from the hull 1 as an extension of a deck of a craft or boat in terms of function and design. Incidentally, on the upper surface of the case cover 102, an anti-slip function is provided, and by an anti-slip effect of the function, not only taking in a net, taking in a caught fish, and pulling in of a target person during rescue become possible, which have been impossible with a conventional outboard motor, but also bringing the stern close to a pier is possible for allowing boarding or getting off the boat via the stern. Incidentally, as the anti-slip function, on the upper surface of the case cover 102, appropriately sized concaves and convexes may be formed, or a separate anti-slip rubber or the like may also be attached.

Figure 13:
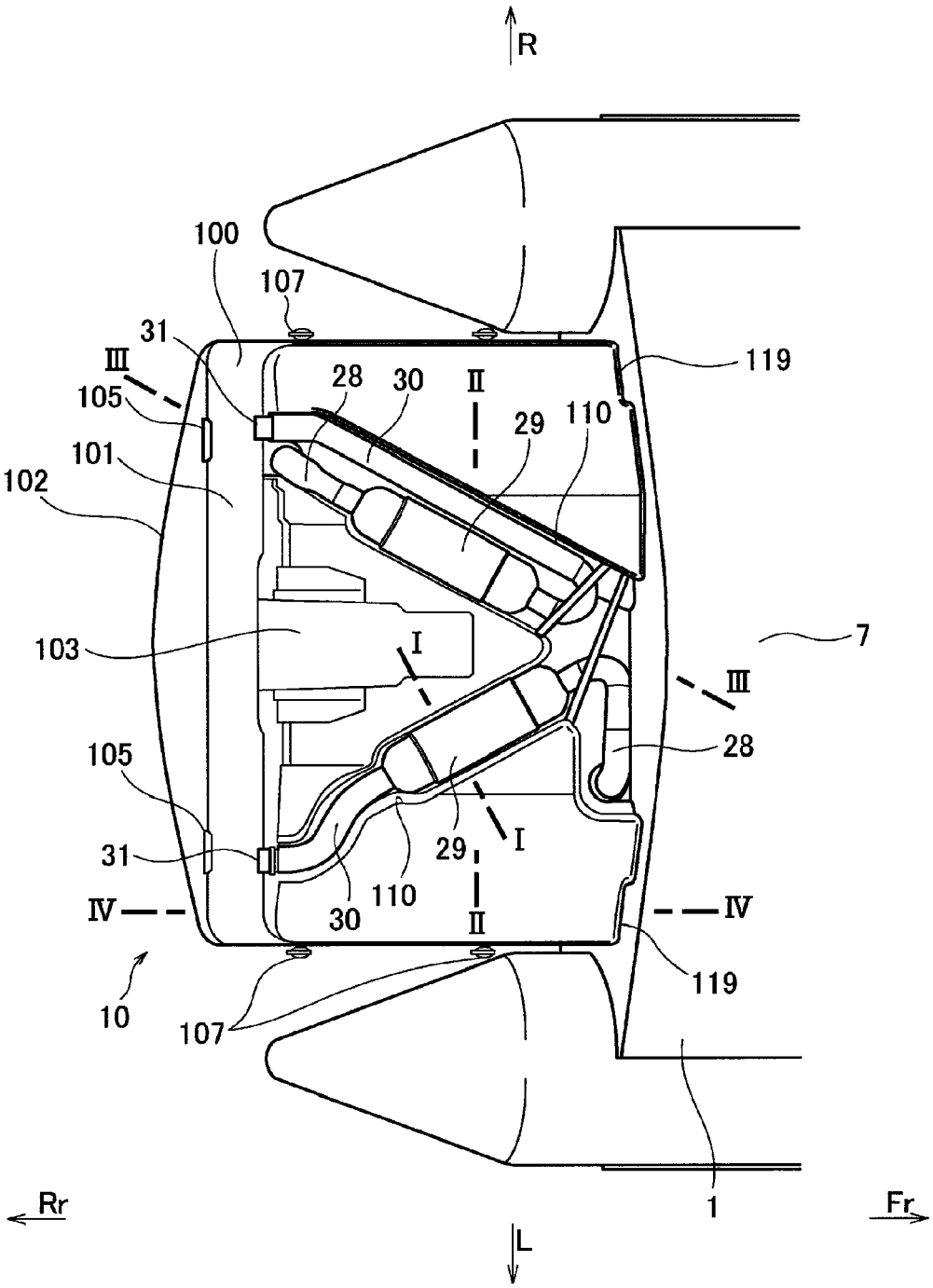
FIG. 13 is a bottom view illustrating a muffler disposition example in the engine case of the outboard motor of the present invention.
Figure 14:
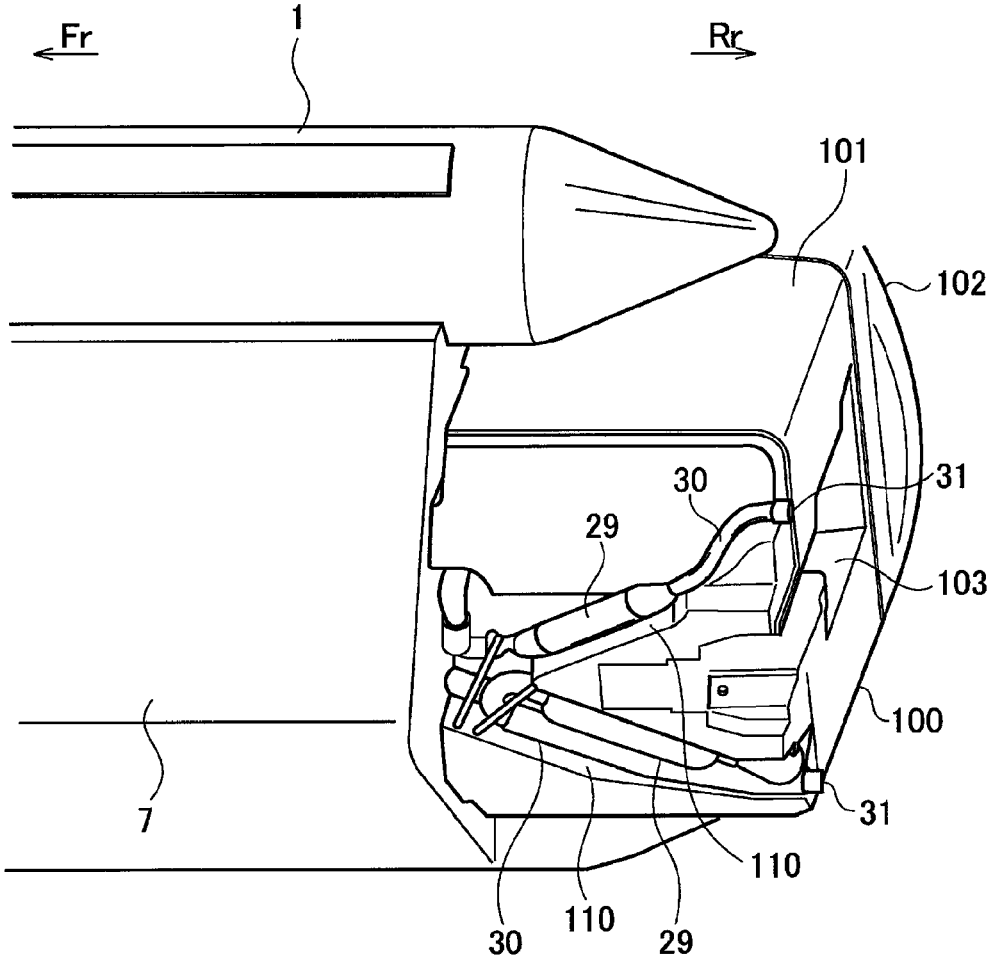
FIG. 14 is a lower perspective view illustrating the muffler disposition example in the engine case of the outboard motor of the present invention.

Next, as has been described already, the mufflers 29 are installed on the exterior of the lower surface of the case main body 101. As illustrated in FIG. 13 and FIG. 14, in a bottom view, the paired mufflers 29 are disposed on the lower surface of the case main body 101 so as to exhibit a substantially truncated "V" shape, in other words, so as to correspond to two sides of equal length of a substantially isosceles triangle. In the above case, the muffler 29 to be connected to the right engine unit 11 is disposed such that an upstream side of an exhaust gas flow flowing through the inside of the muffler 29 is positioned at the rear, and the muffler 29 to be connected to the left engine unit 11 is disposed such that an upstream side of an exhaust gas flow is positioned at the front. A center portion of the lower surface of the case main body 101, where these mufflers 29 are disposed, is substantially flat, and both right and left sides of the above center portion are moderately sloped upward. Incidentally, the exhaust hose 30 to be connected to the right muffler 29 is disposed along the vicinity of the right muffler 29 and is connected to the exhaust outlet port 31 in the vicinity of the lower portion of the rear surface of the case main body 101.

Figure 15:
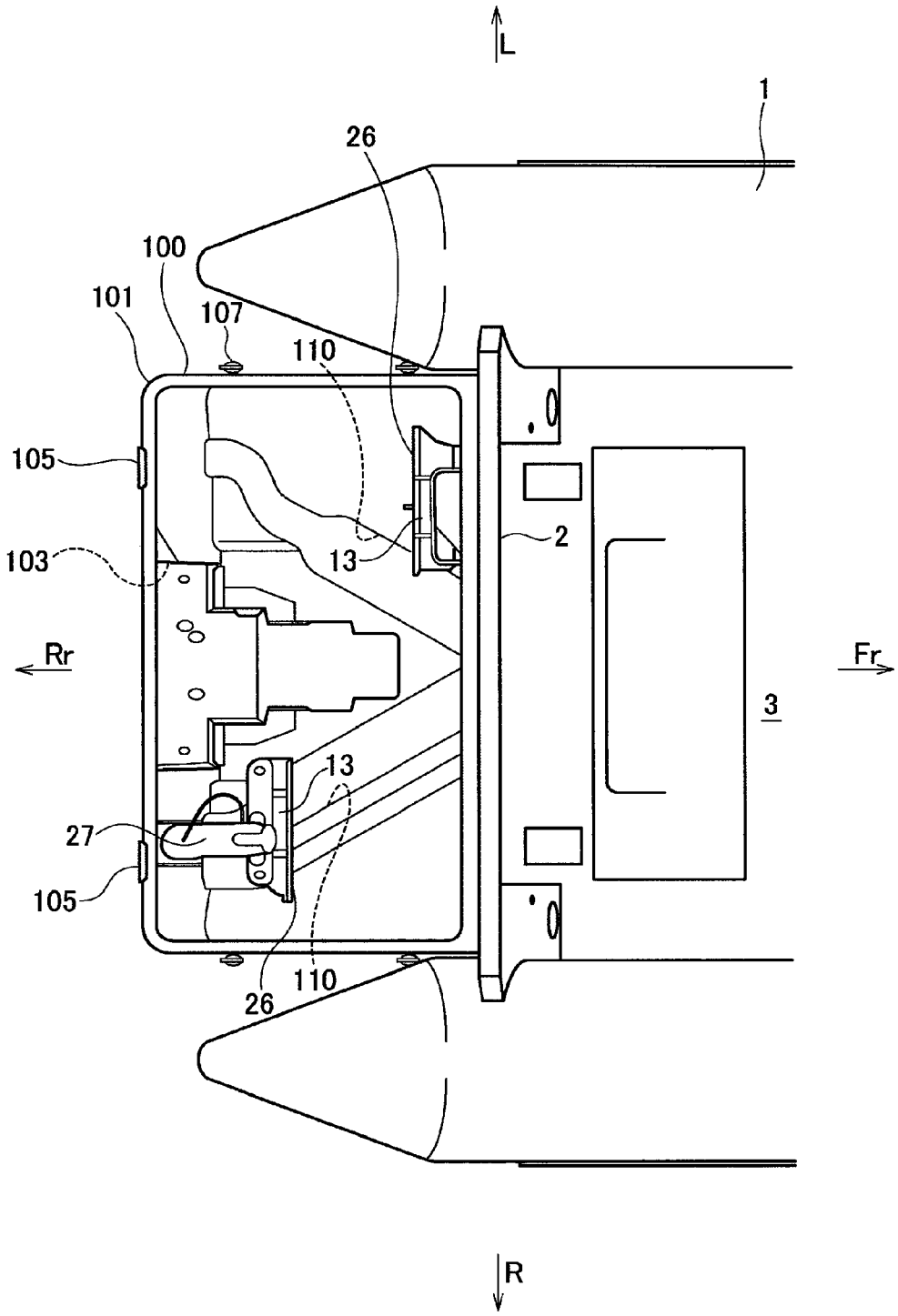
FIG. 15 is a top view illustrating muffler housing portions in the engine case of the outboard motor of the present invention.

The mufflers 29 and the exhaust hoses 30 are disposed so as not to project from the lower surface of the case main body 101. In order to dispose them as above, muffler chambers 110 for each housing the muffler 29 and the exhaust hose 30 are formed on the lower surface of the case main body 101. The above muffler chambers 110 are each provided on the exterior of the lower surface of the case main body 101 to be recessed inwardly of the case main body 101, and a shape projecting inwardly is made on a bottom surface of the case main body 101. The muffler chambers 110, as illustrated also in FIG. 15, exhibit a substantially truncated "V" shape, corresponding to the dispositions of the mufflers 29 and the like.

Figure 16:
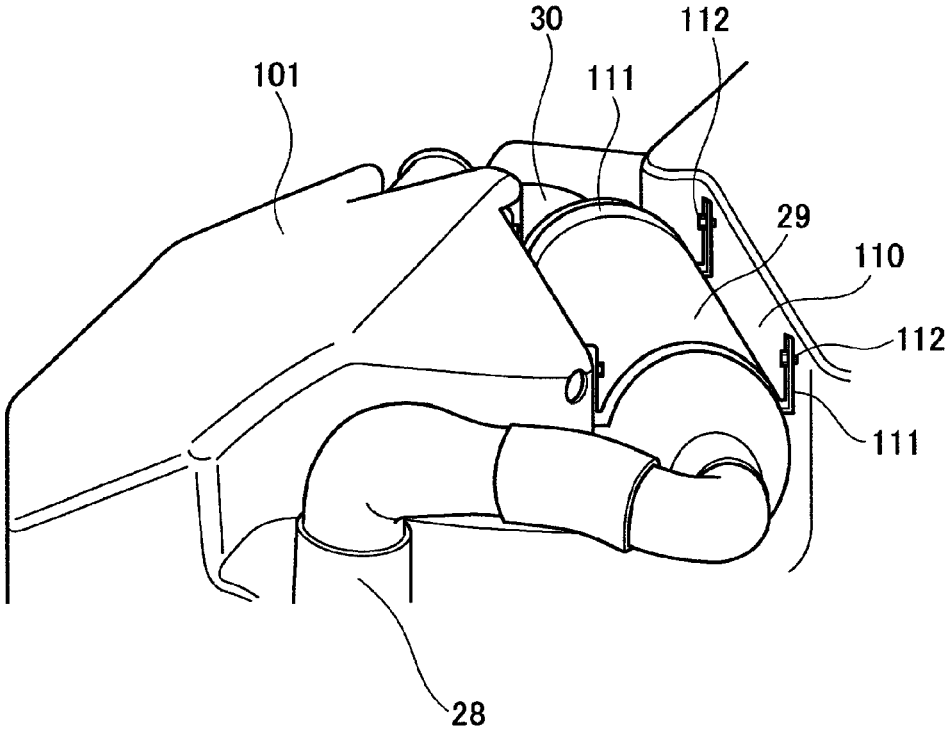
FIG. 16 is a partial perspective view illustrating the muffler housing portion in the engine case of the outboard motor of the present invention.
Figure 17:
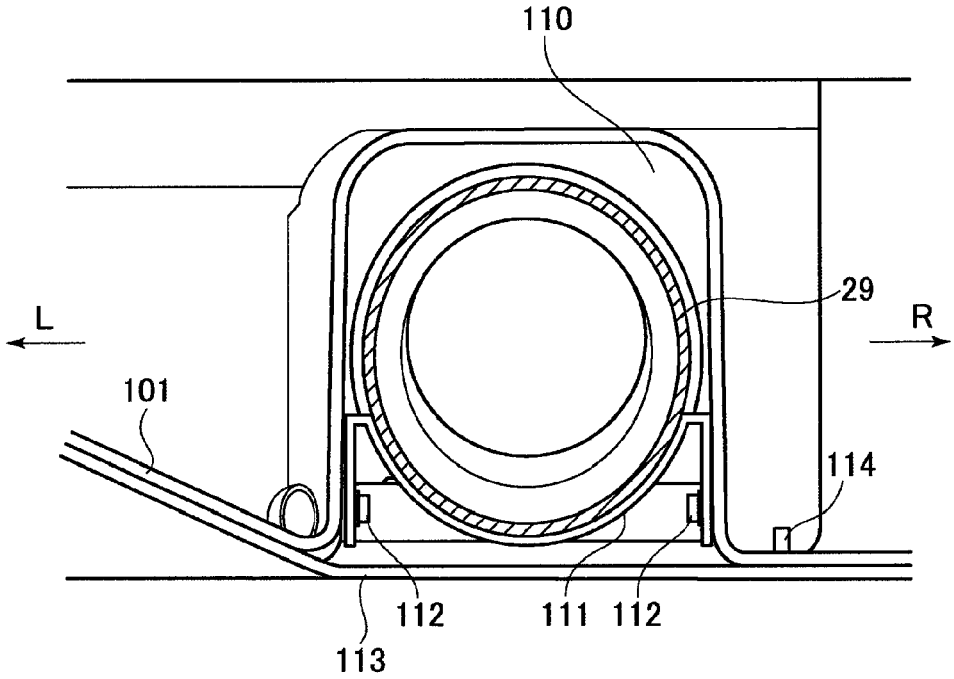
FIG. 17 is a cross-sectional view taken along a line I-I in FIG. 13.

As illustrated also in FIG. 16 to FIG. 19, the mufflers 29 and the exhaust hoses 30 are housed and disposed so as to fit into the muffler chambers 110 completely. That is, the muffler chambers 110 are formed along the shapes of the mufflers 29 and the exhaust hoses 30 connected to the mufflers 29 on the exterior of the case main body 101. In the case, as illustrated in FIG. 16 and FIG. 17, an outer peripheral portion of the muffler 29 is pressed with a moderate force by a plurality of attachment clamps 111, thereby fixing the muffler 29 to the inside of the muffler chamber 110 accurately. Incidentally, the attachment clamps 111 are fastened and fixed to a case main body 101 side by bolts 112. By providing the muffler chambers 110 as above, uneven ups and downs are formed on the bottom surface of the case main body 101. Thus, it is possible to effectively strengthen rigidity of particularly the vicinity of the bottom surface of the case main body 101.

Figure 18A:
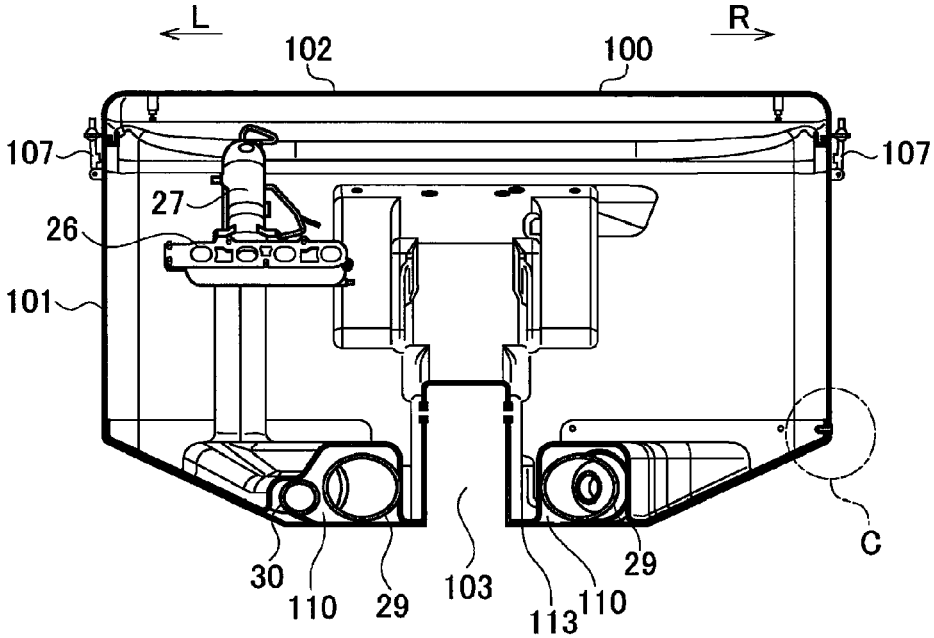
FIG. 18A is a cross-sectional view taken along a line II-II in FIG. 13.
Figure 19:
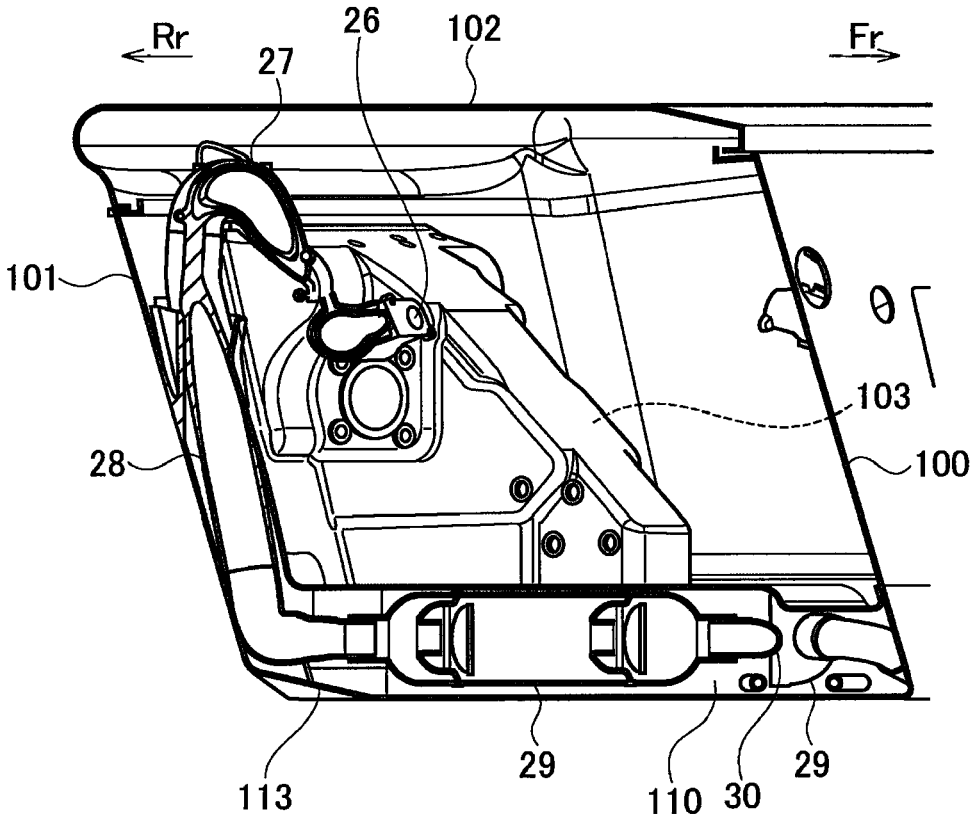
FIG. 19 is a cross-sectional view taken along a line III-III in FIG. 13.

The mufflers 29 and so on disposed in the muffler chambers 110 as described above are covered with a muffler cover 113 as illustrated in FIG. 18A or FIG. 19. The muffler cover 113 is coupled to the circumference of the bottom portion of the case main body 101, and is fastened and fixed by later-described screws or bolts while being coupled thereto. Attachment of the muffler cover 113 makes a lower surface of the engine case 100 quite flat and smooth. In the above case, corresponding to the center portion of the lower surface of the case main body 101, the muffler cover 113 is also formed to be substantially flat. Further, as illustrated in FIG. 2, FIG. 3, and the like, drain holes 113*a* are formed.

Figure 18B:
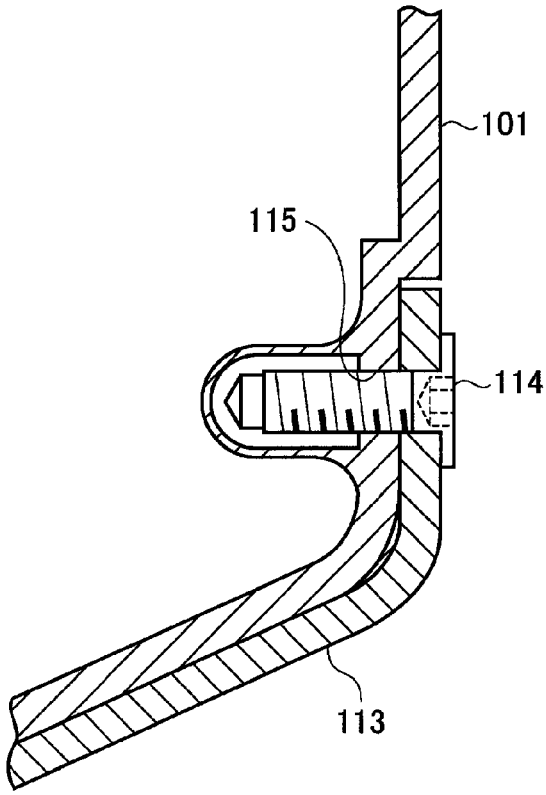
FIG. 18B is an enlarged view of a C portion in FIG. 18A.

Here, as illustrated in FIG. 18B, the muffler cover 113 is fastened to the case main body 101 by a plurality of flat-head screws 114. As is in the illustrated example, female screw portions 115 are provided in the case main body 101 side, and the flat-head screws 114 are screwed into the above female screw portions 115. As for positions where the flat-head screws 114 are provided, as illustrated in FIG. 20A and FIG. 20B, a plurality of positions are set at a bottom portion of the muffler cover 113 corresponding to the recessed portion 103 of the case main body 101, along an upper peripheral edge portion of the muffler cover 113 roughly formed in, for example, a plate shape.

Figure 20A:
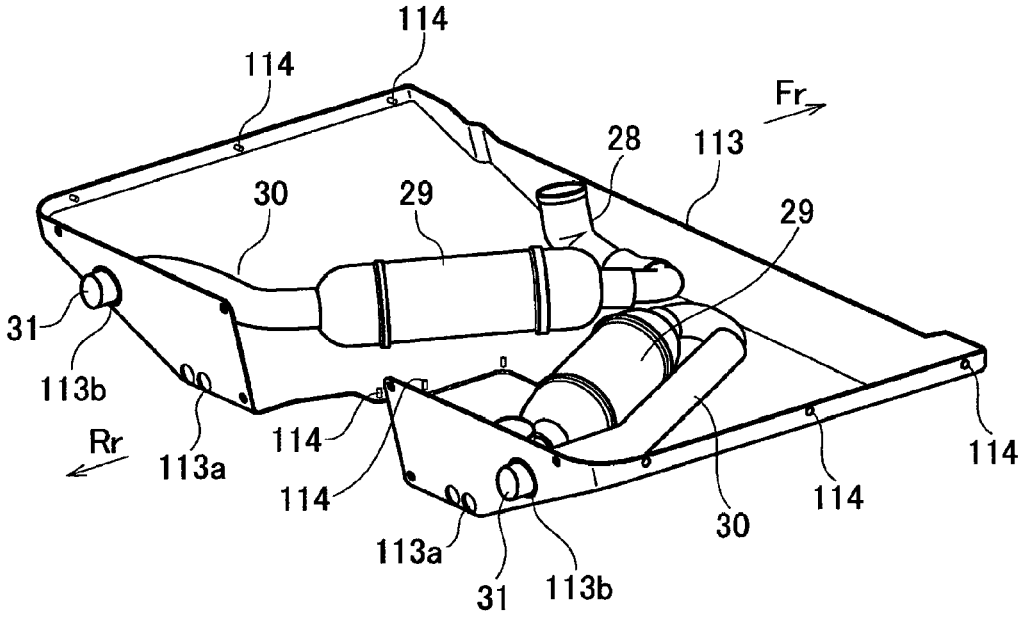
FIG. 20A is a rear perspective view illustrating a disposition relationship of a muffler cover and mufflers in the engine case of the outboard motor of the present invention.
Figure 20B:
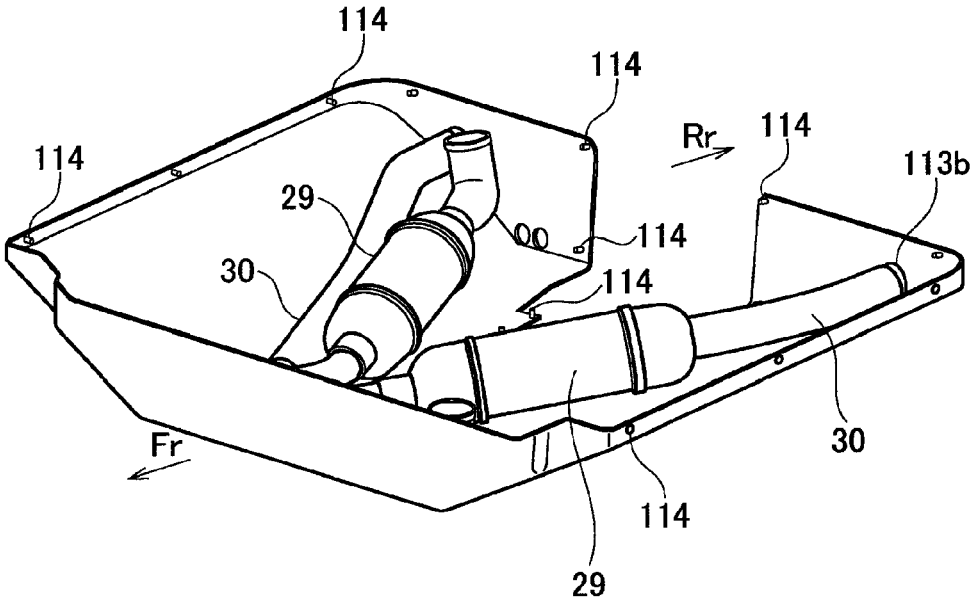
FIG. 20B is a front perspective view illustrating the disposition relationship of the muffler cover and the mufflers in the engine case of the outboard motor of the present invention.

Further, in FIG. 20A and FIG. 20B, a relative disposition relationship of the mufflers 29 and the muffler cover 113 is illustrated. The mufflers 29 to be housed in the muffler chambers 110 of the case main body 101 are disposed to be housed in a thin plate-shaped recessed portion of the muffler cover 113 substantially, as illustrated in FIG. 20A and FIG. 20B.

Figure 21A:
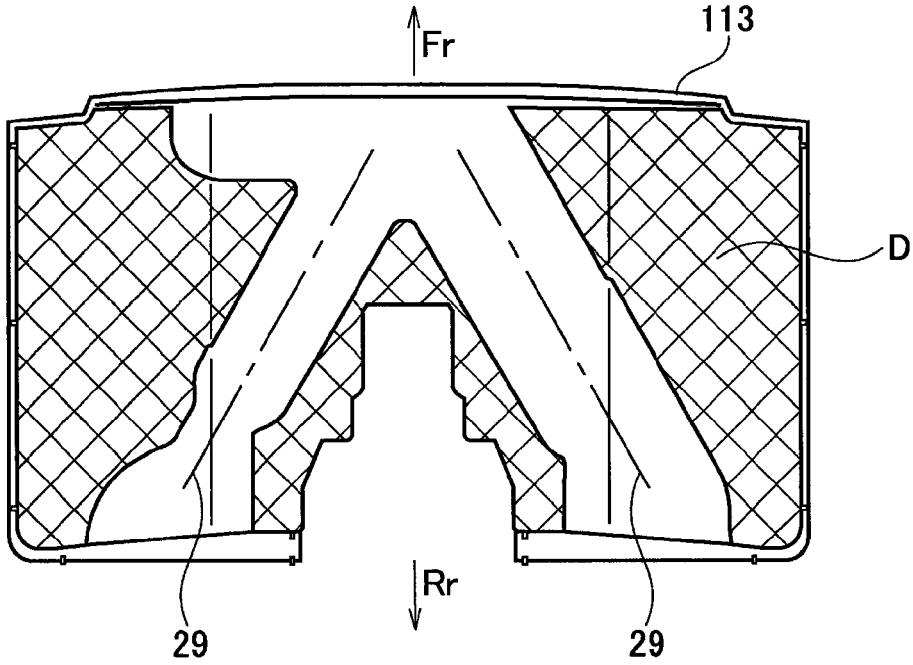
FIG. 21A is a plan view of the muffler cover in the engine case of the outboard motor of the present invention.
Figure 21B:
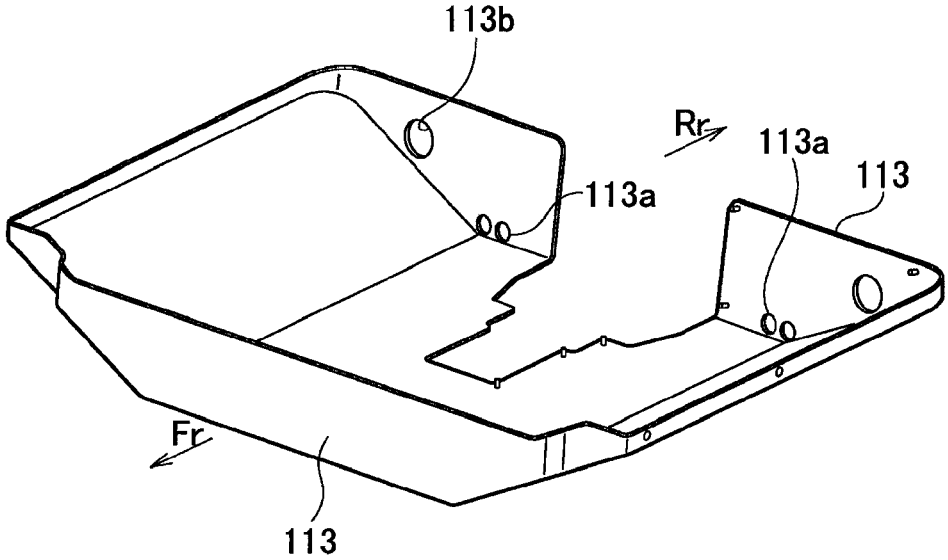
FIG. 21B is a front perspective view of the muffler cover in the engine case of the outboard motor of the present invention.

FIG. 21A and FIG. 21B further illustrate a structure of the muffler cover 113 itself. As described above, the muffler cover 113 is attached to the lower surface of the case main body 101, and when being attached thereto, the muffler cover 113 comes into close contact with a region D in FIG. 21A of the lower surface of the case main body 101. The above region D corresponds to a region where the muffler chambers 110 housing the mufflers 29 are not disposed in the case main body 101. That is, the muffler chambers 110 are recessed to have a recess, so that the muffler cover 113 does not come into close contact with the above region. Further, as illustrated in FIG. 21B, the previously described drain holes 113*a*, and holes 113*b* for inserting the exhaust outlet ports 31 are formed at a rear end portion of the muffler cover 113.

Figure 22:
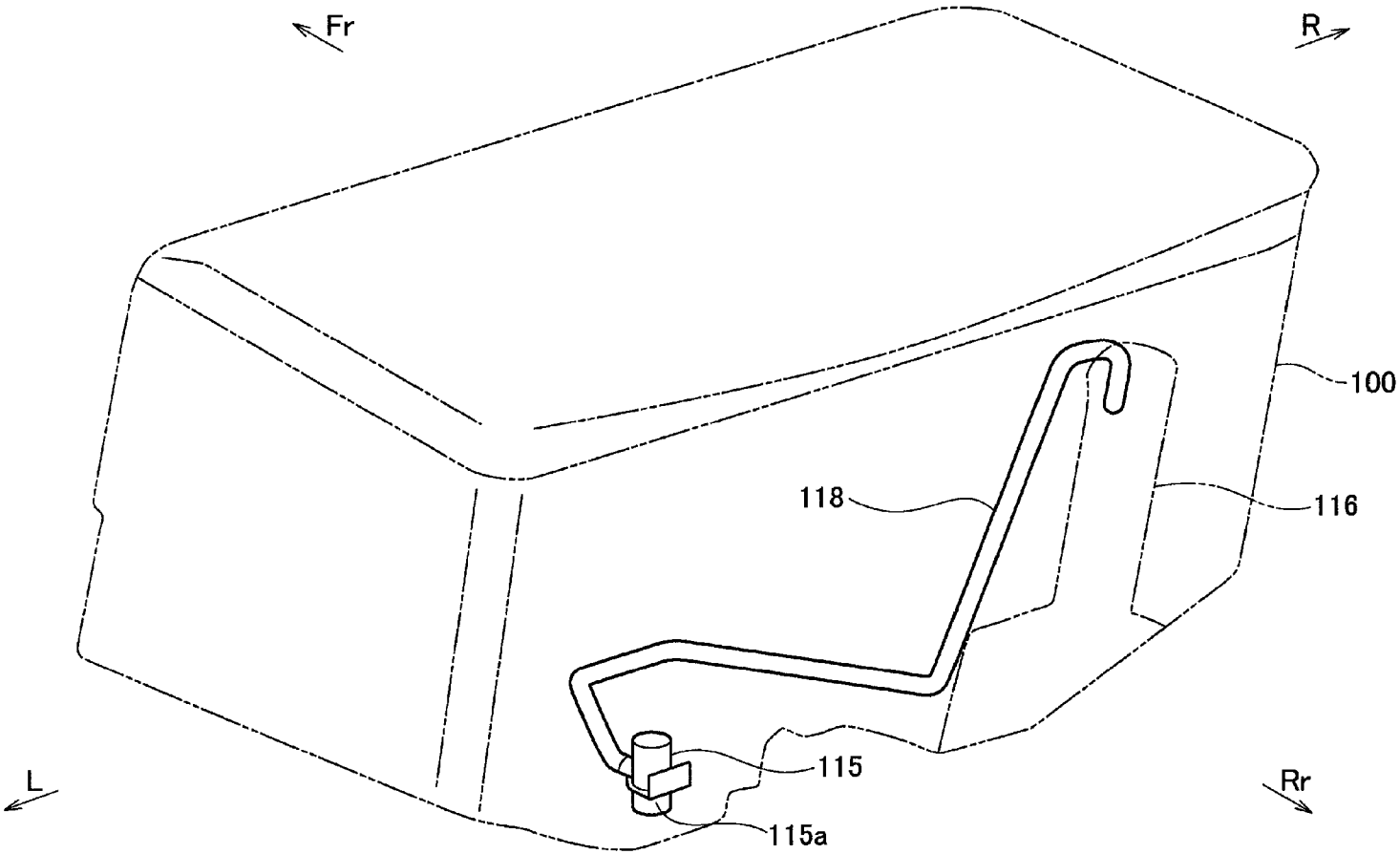
FIG. 22 is a perspective view illustrating a constitution and disposition example of the vicinity of a bilge pump in the engine case of the outboard motor of the present invention.
Figure 23:
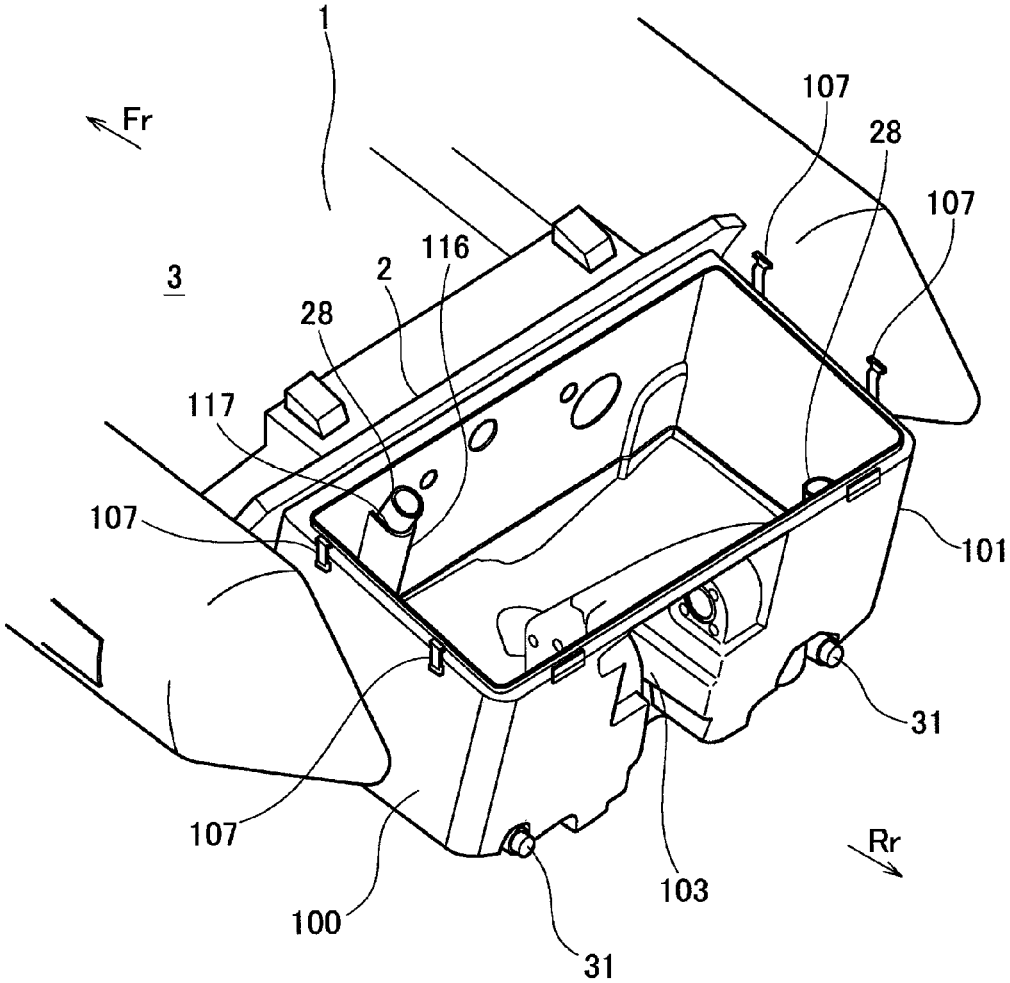
FIG. 23 is a perspective view illustrating a constitution and disposition example of the vicinity of a partition wall for drainage in the engine case of the outboard motor of the present invention.

Further, a later-described bilge pump is disposed inside the case main body 101, and it is designed such that water accumulated inside the case main body 101 is collected and discharged by the above bilge pump. As illustrated in FIG. 22, a bilge pump 115 has a water intake port 115*a* thereof disposed at the bottom portion being an appropriate position of the bottom surface of the case main body 101 typically. The water intake port 115*a* may also be disposed in the vicinity of the muffler chambers 110 projecting on the bottom surface of the case main body 101, or the like, for example. Then, as is in FIG. 23, at two positions of a right rear portion and a left front portion of the case main body 101, in plan view, a partition wall 116 is provided along an exterior of the exhaust hose 28 disposed substantially vertically inside the case main body 101 so as to have a moderate gap from the exhaust hose 28. A gap 117 between an outer peripheral surface of the exhaust hose 28 and the partition wall 116 communicates with the outside of the case main body 101, and the above gap 117 serves as a drainage guide passage. Water can be discharged via the above gap 117.

In the above case, it is designed such that, as is in FIG. 22, a supply pipe 118 of water sucked by the bilge pump 115 is extended and routed to the gap 117 inside the partition wall 116, and water accumulated inside the case main body 101 is once pumped up to an upper end of the partition wall 116, and the water goes along the inner side of the partition wall 116 down to a lower portion of the partition wall 116, and then is discharged. Incidentally, the supply pipe 118 may be provided to the right exhaust hose 28 as illustrated in FIG. 22, or can be provided to the left exhaust hose 28, or can also be provided to both the exhaust hoses 28. In any case, even when a draft position is positioned higher than a bottom surface of the engine case 100 while the boat is stopping (mooring) or the like, water around the mufflers 29 does not enter the engine case 100.

Figure 24:
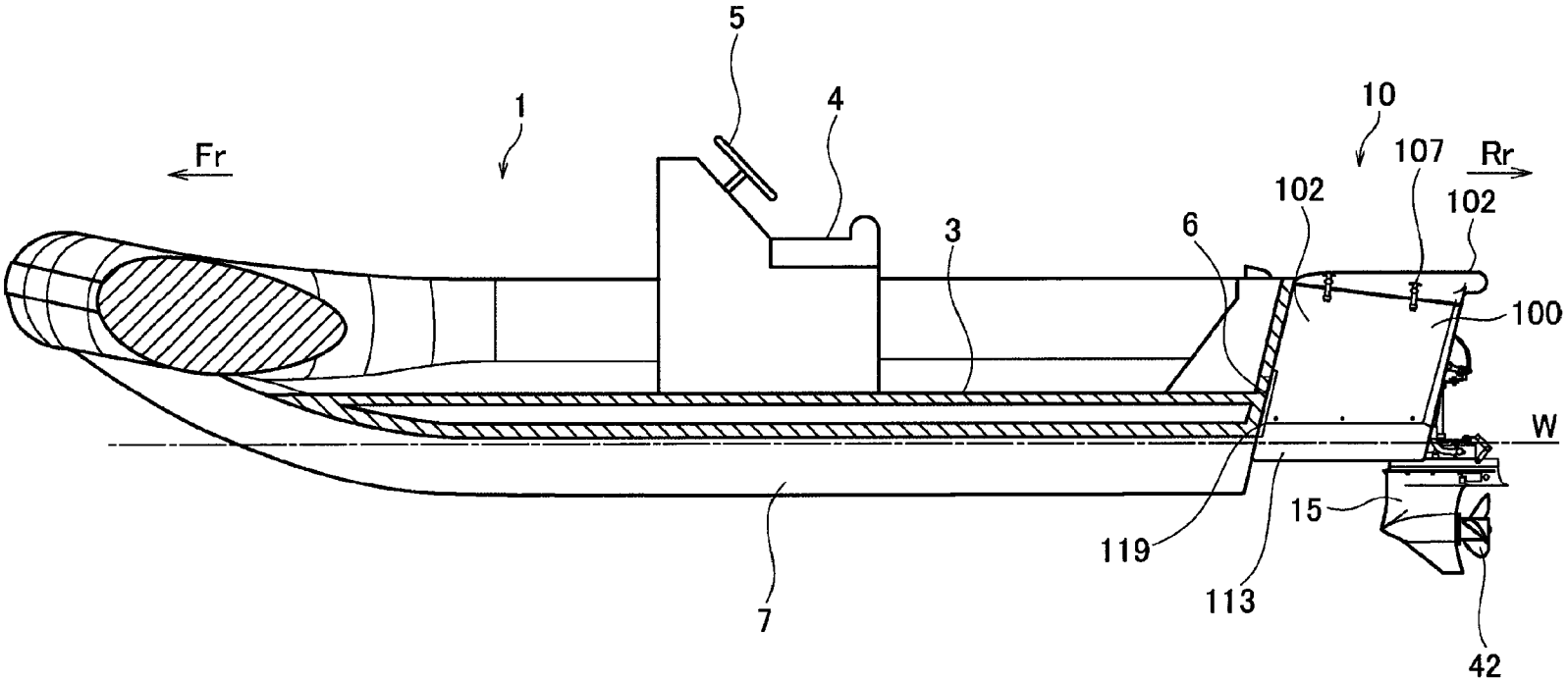
FIG. 24 is a cross-sectional view taken along a line IV-IV in FIG. 13.

Further, as illustrated in FIG. 5 or FIG. 12, a recess 119 is provided at both side edges of the front surface of the case main body 101. Then, corresponding to these recesses 119, through holes 6 are opened in the transom board 2 as illustrated in FIG. 24. The above through holes 6 are set at a quite high position from a boat bottom 7 of the hull 1, and are positioned above a water line W.

Water accumulated on a floor surface of the hull 1 is discharged outside the boat via the through holes 6 opened in the transom board 2, and further is guided downward between the transom board 2 and the recesses 119 of the case main body 101. In this manner, it is possible to guide water accumulated on the boat floor 3 downward through the recesses 119 to be discharged outside the boat.

In the above-described case, besides the above-described components of the outboard motor 10, a cooling piping system for the engine units 11, a hydraulic piping system for driving the tilt mechanism and the steering mechanism, and electrical signal lines, cords, or the like for transmitting and receiving electrical signals, power or the like between the members or the like are routed to appropriate positions inside the engine case 100, and auxiliary machines necessary for operation of the outboard motor 10 are disposed. Then, the appropriate operation of the outboard motor 10 is performed via these piping systems or the like, or by operation of the auxiliary machines.

Next, the main components, their effects, and so on in the present invention will be explained summarily. First, in the present invention, the outboard motor 10 in which horizontal engines are mounted is attached to the transom board 2 of the hull 1 with the use of the transom bolts 45. Then, an upside of the engine case 100 is only opened, namely a front surface, side surfaces, a rear surface, and the bottom surface of the engine case 100 are formed integrally to thereby make a watertight structure. The upside of the engine case 100 is covered with the case cover 102. Further, if the case cover 102 is opened, the engine units 11 can be detached while the engine case 100, the frame 16, and the propulsion unit 15 being attached to the hull 1.

On the exterior of the lower surface (a lower side) of the engine case 100, the two mufflers 29 are disposed. These mufflers 29 are disposed so as to be housed in the muffler chambers 110 being housing portions for attaching mufflers. The muffler cover 113 is structured by a flat and smooth surface without irregularities and does not disturb water flow flowing under a lower surface of the boat bottom 7. Incidentally, the muffler chambers 110 generate irregular bead portions on a bottom surface structure of the case main body 101, so that the shapes of beads make it possible to strengthen rigidity of the vicinity of the bottom surface of the case main body 101 without using a reinforcing part such as a special bracket.

Further, a hydraulic pressure to be transmitted via the muffler cover 113 while the boat is planing, and a reaction force of its own weight of the hull 1 to be transmitted via the muffler cover 113 from a shipway when the boat is placed on the land can be applied to the muffler cover 113 without increasing weight of the muffler cover 113.

The mufflers 29 are attached in a watertight manner by the bolts 112 and female screws provided in the case main body 101 via the attachment clamps 111. Even in the case when the muffler cover 113 is detached for maintenance or the like, the mufflers 29 can be supported by being hung from an engine case 100 side. As above, the engine case 100 is excellent in user-friendliness and usability to improve convenience.

The exhaust hoses 28 and 30 are connected to the front and rear of each of the mufflers 29, and the muffler chambers 110 are each formed so as to substantially perfectly correspond to the shapes of the muffler 29 and the exhaust hoses 28 and 30. A space between the mufflers 29 and the exhaust hoses 28, 30, and the muffler chambers 110 is minimized. Such a space is filled with water because while the boat being mooring (stopping on the water), the space is positioned below the water surface, but the space is positioned on the water surface while the boat being planing, and thus the water is discharged from the drain holes 113*a*. An amount of water to be discharged is small, so that mass (water) progressing with the hull 1 is reduced, and thereby acceleration is improved.

Further, exhausts from the engine units 11 are led to the exhaust hoses 28 through the exhaust manifolds 26 and the exhaust pipes 27 and are connected to the mufflers 29. In the above case, the exhaust manifolds 26 and the exhaust pipes 27 each have a water jacket and are made of metal, and it is structured such that seawater to be injected into the inside of the exhaust pipes 27 cools down portions of exhaust to flow subsequently (a wet exhaust method).

Then, according to the present invention, particularly, the case main body 101 and the case cover 102 covering the opening 101*a* of the case main body 101 are included, and thereby it is possible to effectively protect the engine units 11, engine outfits of the engine units 11, and so on that are housed in the engine case 100 from a wetting environment. Further, holding of the engine units 11 themselves, propelling force and steering force of the propulsion unit 15, and so on are received by the frame 16, and thereby as for the engine case 100 itself, a material and structure specialized in watertightness and design are achieved, which are inexpensive.

Further, the bottom surface and side surfaces of the engine case 100 that are close to the water surface and are required to have more precise watertightness are not opened, so that a simple structure makes it possible to secure watertightness. Further, with the engine case 100 and the frame 16 being attached to the hull 1 of the boat, the engine units 11 can be attached and detached while being hung, and attachment, detachment, and so on are quite easy to be performed.

Further, the mufflers 29 are installed on an exterior of a case lower surface of the engine case 100, and on the case lower surface, the muffler chambers 110 housing the mufflers 29 and the exhaust hoses 30 are formed. By disposing the heavy and wet mufflers at a bottom portion of the engine case 100 in this manner, a gravity center position of the entire outboard motor 10 can be lowered.

Further, a suction pump is installed at an appropriate position of a case bottom surface of the engine case 100, and it is designed such that water can be sucked at a suction part of the suction pump disposed at a bottom portion of the case bottom surface, namely at the water intake port 115*a*. In the above case, the partition wall 116 is formed along the substantially upward and downward direction inside the engine case 100, and a sucked-water supply pipe is provided between the upper end portion of the drainage guide passage set inside the above partition wall 116 and the suction pump. Thereby, a drainage path does not directly come into contact with the outside from the engine case 100, so that watertightness of a portion with which the drainage path comes into contact is not required to be considered.

Further, the recesses 119 provided at both side edges of a case front surface and the through holes 6 formed in the transom board 2 to correspond to the above recesses 119 are made to communicate, and water accumulated on the floor surface of the hull is guided downward through the recesses 119 to be discharged.

Thereby, it is possible to discharge water on the floor surface of the hull from invisible places, which is advantageous also to design.

Further, the muffler cover 113 coupled to a case bottom portion of the engine case 100 and covering the mufflers 29 is placed. Thereby, the mufflers 29 are not directly exposed to objects running in the water, and by covering the case lower surface by the flat and smooth muffler cover 113, it is designed such that running objects do not bump against the mufflers 29. Further, by making the case lower surface flat and smooth, before planing in particular, a water flow to rise from a rear portion end of the hull 1 of the boat is received, transition to planing is facilitated, and large engine output is not required, thus improving fuel efficiency.

Further, the muffler cover 113 is formed to be consistent with the case main body 101 to achieve integral design. A capacity of the muffler chambers (the volume of the vicinity of the mufflers) can be reduced. When the muffler chambers are positioned on the water surface at the time of planing, landing, and the like, water around the mufflers 29 can be discharged for a short time period.

Furthermore, the irregular beads are generated on the case bottom surface of the engine case 100, and thereby rigidity of a case bottom surface portion can be strengthened. The case bottom surface and the muffler cover 113 abut on the region other than the mufflers 29 to make a two-layer structure, and thereby it becomes easy to transmit force by water flow to the engine case 100 from the muffler cover 113, and it is possible to reduce rigidity of the muffler cover 113 practically and to achieve a reduction in its weight.

Here, the main components, their effects, and so on in the present invention will be further explained. In the present invention, exhausts once sent up from the exhaust manifolds 26 in the exhaust system 13 are mixed with water to then be guided to the mufflers 29 disposed under the engine case 100 through the exhaust hoses 28. Unlike a stern drive boat, exhaust system parts such as the mufflers 29 are not exposed to the outside, and further are not provided with portions that receive occurrence of bending caused by tilting and steering, so that the exhaust system parts are excellent in weather resistance, light resistance, and mechanical deterioration.

In the above case, the mufflers 29 are housed in hollows on the lower surface of the case main body 101 of the engine case 100, namely in the muffler chambers 110, so that a contact area of the muffler cover 113 to the lower surface of the case main body 101 can be increased. Thereby, when a water flow flows under the bottom surface of the boat, the muffler cover 113 (the lower surface of the engine case 100) formed along the boat bottom 7 of the hull 1 (see FIG. 13 and FIG. 14) facilitates transmission of a pressure of the water flow that is released to rise upward, to the engine case 100 and the frame 16.

Further, the mufflers 29 are disposed on the exterior of the lower surface of the engine case 100, so that exhaust heat does not increase the temperature inside the engine case 100. The engines are disposed at a position higher than that of a stern drive boat, so that it is easy to avoid wetting, back flow, or the like and to bring the engines into a dry environment.

Further, at an abutting portion of the muffler cover 113 and the case main body 101, as illustrated in FIG. 18B, a portion equivalent to a sheet thickness of the muffler cover 113 is removed from the case main body 101, so that the abutting portion is flat and smooth as a whole. When a craft or boat travels, the muffler cover 113 receives a water flow to rise, and thereby the moment in a direction of lowering a bow is applied to the boat. The above water flow is maximum at the time of transition to planing, so that the muffler cover 113 functions as a lifting force generating device to facilitate the transition to planing. Accordingly, a large-sized engine allowing transition to planing for a short period of time is not required, so that a substantial reduction in size of the outboard motor 10 can be achieved. Further, the outboard motor 10 is excellent in acceleration as compared with an outboard motor in which no planing transition device is included, particularly, an outer bracket is attached, and the center of gravity is away from a hull.

Further, joining of the muffler cover 113 and the case main body 101 is performed by the flat-head screws 114, and projecting regions are held to a minimum, and thereby the muffler cover 113 is not easily affected by surrounding water flow, and fluid resistance is reduced. Further, by fastening the muffler cover 113 to the case main body 101 by the flat-head screws 114 in this manner, it becomes possible to make it difficult for the muffler cover 113 to be detached from the engine case 100. Furthermore, by removing the flat-head screws 114 being bolts for attaching the muffler cover 113, an inspection and maintenance work of the mufflers 29 can be performed simply.

Furthermore, as illustrated in FIG. 21B and the like, a flat surface and sloped surfaces are provided at the bottom portion of the muffler cover 113, and when the outboard motor 10 itself is placed on a floor, the flat surface is made to come into contact with the floor, or the sloped surfaces are made to come into contact with a V-shaped base, and thereby the outboard motor 10 can be stabilized.

Further, the exhaust outlet ports 31 are provided in a rear surface of the muffler cover 113, and at the time of low speed, exhausts are discharged from a different exhaust system below the water surface, and at the time of high speed (planing) on the other hand, exhausts are discharged above the water surface and from a position farthest from a driver's seat, so that it is possible to reduce an exhaust noise and exhaust that reach a driver. Furthermore, in a rear end of the muffler cover 113, the drain holes 113*a* through which water accumulated around the mufflers 29 while the boat is mooring (not planing) is drained when landing (at the time of transition to planing) are opened.

Then, according to the present invention, particularly, the muffler chambers 110 are provided on the lower surface of the engine case 100, and the mufflers 29 housed in the above muffler chambers 110 are covered with the muffler cover 113.

Thus, by disposing the heavy and wet mufflers 29 in a lower portion of the engine case 100, the center of gravity of the entire outboard motor 10 is lowered and stable traveling of the boat is ensured. Further, by the attachment of the muffler cover 113, the mufflers 29 are not directly exposed to objects running in the water and are not affected by running objects, resulting in that the mufflers 29 can be protected effectively.

Further, making the lower surface of the engine case 100 flat and smooth allows the muffler cover 113 to receive a water flow to rise from a rear end portion of the hull 1 before planing, and thereby transition to planing can be performed simply and precisely. As a result that a large-sized engine is not required, fuel efficiency of the outboard motor 10 is improved. Furthermore, the muffler cover 113 is formed to be consistent with the case main body 101, and thereby integrated design as the entire outboard motor 10 can be achieved.

Further, the muffler chambers 110 are each formed along the shapes of the muffler 29 and the exhaust hose 30, thereby reducing a substantial capacity of the muffler chambers 110. Then, when the muffler chambers 110 are positioned above the water surface at the time of planing, landing, and the like, water around the mufflers 29 can be discharged for quite a short period of time, resulting in that work efficiency can be improved. Further, by providing the muffler chambers 110 in this manner, the irregular beads are formed on the bottom surface of the case main body 101, resulting in that rigidity of particularly, the vicinity of the bottom surface of the case main body 101 can be strengthened effectively. Furthermore, a relatively large close contact area of the muffler cover 113 and the lower surface of the case main body 101 is secured, resulting in that transmission of resistance by water flow to the case main body 101 from the muffler cover 113 is facilitated.

Furthermore, as described previously, by fastening the muffler cover 113 to the case main body 101 by the flat-head screws 114, fluid resistance is reduced.

In the foregoing, the present invention has been described with the embodiment, but the present invention is not limited to this embodiment, and changes and the like may be made within the scope of the present invention.

In the above-described embodiment, an example where the two engine units are mounted has been explained, but the single engine unit may be employed, or the three engine units may also be employed, and further the propulsion unit can also be increased accordingly.

In the above-described embodiment, the number of the flat-head screws 114 used for fixing the muffler cover 113, and the like can be increased and reduced according to need.

According to the present invention, the opening at the upper portion of the case main body is covered with the case cover, and thereby it is possible to effectively protect the engine units and so on housed in the engine case from a wetting environment. Further, holding of the engine units, propelling force of the propulsion unit, and so on are received on a frame side, and thereby the engine case itself can be constituted to specialize in watertightness and design. Further, with the engine case and so on being attached to the hull, the engine units can be attached and detached while being hung, and attachment, detachment, and so on are quite easy to be performed, resulting in that the engine case is quite excellent in user-friendliness, usability, and so on.

Further, according to the present invention, the muffler chambers are provided on the lower surface of the engine case and the mufflers housed in the above muffler chambers are covered with the muffler cover. Thereby, the heavy and wet mufflers are disposed in the lower portion of the engine case, resulting in that the center of gravity of the entire outboard motor is lowered and stable traveling of the boat is ensured. Further, by the attachment of the muffler cover, the mufflers are not directly exposed to objects running in the water and are not affected by running objects, resulting in that the mufflers can be protected effectively.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An engine case of an outboard motor being an engine case of an outboard motor that houses an engine in the case and includes a propulsion unit outside the case, the engine case of the outboard motor, comprising:

a case main body housing the engine and assemblies of peripheral parts of the engine; and a case cover covering an opening at an upper portion of said case main body, wherein a muffler is installed on an exterior of a lower surface of the case main body, and a muffler chamber housing the muffler and an exhaust hose is formed on the lower surface of the case main body.

2. The engine case of the outboard motor according to claim 1, wherein the muffler chamber is provided to be recessed inwardly of said case main body from an exterior of a lower surface of said case main body.

3. The engine case of the outboard motor according to claim 2, wherein the muffler chamber is formed along shapes of the muffler and the exhaust hose connected to the muffler.

4. The engine case of the outboard motor according to claim 1, wherein a muffler cover coupled to a bottom portion of the case main body and covering the muffler housed in the muffler chamber is placed.

5. The engine case of the outboard motor according to claim 4, wherein the muffler cover is fastened to said case main body by a flat-head screw.

6. The engine case of the outboard motor according to claim 1, wherein a suction pump is installed at an appropriate position of a bottom surface of the case, and it is designed such that water is allowed to be sucked at a suction part of the suction pump disposed at a bottom portion of the bottom surface of the case.

7. The engine case of the outboard motor according to claim 6, wherein a partition wall is formed along a substantially upward and downward direction inside the case, and a sucked-water supply pipe is provided between an upper end portion of a drainage guide passage set inside the above partition wall and the suction pump.

8. The engine case of the outboard motor according to claim 7, wherein a part of an exhaust system connected between the engine and the muffler is disposed inside of the partition wall.

* * * * *